US007992646B2

(12) United States Patent
Wright et al.

(10) Patent No.: US 7,992,646 B2
(45) Date of Patent: Aug. 9, 2011

(54) HORIZONTAL OFFLINE STAND BUILDING SYSTEM

(75) Inventors: Monte Neil Wright, Calgary (CA); Roman Vakulin, Calgary (CA)

(73) Assignee: Weatherford Canada Partnership, Edmonton,Albeta (CA)

( * ) Notice: Subject to any disclaimer, the term of this patent is extended or adjusted under 35 U.S.C. 154(b) by 325 days.

(21) Appl. No.: 12/318,465

(22) Filed: Dec. 30, 2008

(65) Prior Publication Data

US 2010/0163247 A1 Jul. 1, 2010

(51) Int. Cl.
*E21B 19/15* (2006.01)
*E21B 19/16* (2006.01)

(52) U.S. Cl. ..... 166/380; 166/77.51; 166/379; 175/52; 175/85; 414/22.54; 414/22.58

(58) Field of Classification Search ..... 175/52, 175/85; 414/22.52, 22.54, 22.57–22.59, 414/22.61, 22.62; 166/380, 77.51, 85.1, 166/85.5

See application file for complete search history.

(56) References Cited

U.S. PATENT DOCUMENTS

2006/0285941 A1* 12/2006 Fikowski et al. ..... 414/22.54
2007/0221385 A1* 9/2007 Braun et al. ..... 166/379

OTHER PUBLICATIONS

U.S. Appl. No. 11/689,279, filed Sep. 27, 2007, Braun et al.

* cited by examiner

*Primary Examiner* — Giovanna C Wright
(74) *Attorney, Agent, or Firm* — Antony C. Edwards

(57) ABSTRACT

A horizontal offline stand building system includes a substantially horizontal, elongate catwalk having a frame and a stand lifting arm. The catwalk has a top surface adapted to receive at least two tubulars aligned coaxially along a linear path in a make-up channel on said top surface. The tubulars are threaded together to form preferably at least a triple pipe stand in the make-up channel. The completed stand is then transferred laterally to a delivery channel containing the stand lifting arm. The stand lifting arm is selectively actuable lifting arm for selectively elevating a rig end of a pipe stand from said top surface of the catwalk to the deck of a drilling rig, and then for supporting the mid and rear sections as the stand is hoisted from the delivery channel up the derrick of the drilling rig.

18 Claims, 34 Drawing Sheets

44
46
12
10
16a
20a 20c
13
D
20a 20c
13
20a 42
20c
13
20a 42
20c
13
20a
16a

42

42
20c
20a
13

42
20c
20a 42
20c
13
20a 42
20c
13
20a
D 42
20c
13
20a
D'

42
20c
13
20a 19a
33a
33
32
20c
22b
22
19b
22a

HORIZONTAL OFFLINE STAND BUILDING SYSTEM

FIELD OF THE INVENTION

The present invention relates to a pipe handling apparatus and, more specifically, to an apparatus and method of horizontal offline pipe stand building for drilling operations wherein stands are formed from tubulars.

BACKGROUND OF THE INVENTION

As stated by Braun in his published US patent application published Sep. 27, 2007 under publication no. 2007/0221385 and entitled Apparatus and Method for Forming Stands, the entire disclosure of which is incorporated herein by reference, various ground drilling operations are known such as exploring and/or extracting oil from subterranean deposits. The drilling operation is conducted on a drill rig comprising a raised drilling platform located above the drilling location. A derrick is provided on the platform to raise, support and rotate a drill string. A drill string includes a drill bit for boring into the ground. As the drilling operation continues, tubular members, commonly referred to as "tubulars" (and referred to herein alternatively as pipes or singles) are connected in an end to end manner to form a drill string. Tubulars are commonly about 30 feet in length and have opposing female and male ends. The ends are threaded in a complementary manner so that opposing male and female ends can be joined together.

The addition of a tubular to an existing drill string is a relatively time consuming and dangerous procedure. Tubulars are provided on a rack from which they are individually rolled onto a horizontal support, such as a catwalk. Both the rack and catwalk are generally located adjacent to the drilling platform with the catwalk being generally positioned perpendicular to the platform. Once on the catwalk, one end of the tubular is attached to a hoist connected either directly of indirectly to the derrick and raised to a vertical position on the drilling platform. The lower end of the tubular is then oriented over the existing drill string and connected to the terminal, surface end thereof. Following connection of the tubular to the drill string and "torquing" to establish a tight connection, the drilling operation is continued. As indicated above, tubulars are generally about 30 feet (10 m) in length. As such, the frequency of adding tubulars to the drill string is high and, therefore, the efficiency of the drilling operation is hampered. In addition, the above described manipulation of the tubulars often requires manual handling and, therefore, increases the risks to the drill rig personnel.

In order to increase the efficiency of the drilling operation, various methods have been proposed to pre-connect at least two tubulars, to form a "stand", prior to connection to the drill string. Such a process is often referred to as "standbuilding". As will be appreciated, such pre-connection step involving two tubulars will reduce by half the number of connections required to be made to the drill string and, therefore, allows the drilling process to continue with fewer interruptions. An example of such a standbuilding procedure is provided in related U.S. Pat. Nos. 6,976,540 and 6,997,265. In these references, a tubular is rolled from a rack onto a ramp positioned adjacent the drilling platform. One end of the tubular is raised by a hoist to a vertical orientation above the drilling platform. The tubular is then inserted into an opening in the drilling platform adjacent to the existing drill string. A further tubular is then vertically hoisted and aligned above the first tubular. The opposing ends are of the two tubulars are then connected together to form a vertical, dual tubular stand. The stand is then raised and secured to the drill string. During formation of the stand, the drilling operation is continued without interruption.

Another example of a standbuilding operation is provided in U.S. Pat. No. 6,705,414. In this reference, a stand is formed on a horizontal catwalk associated with a drilling platform. According to the disclosed method, two tubulars are positioned end to end on the catwalk. A "bucking machine" is then used to join the two tubulars. The bucking machine includes jaws that grasp and axially rotate the tubulars in opposite directions so as to engage the threads on the respective ends and to torque the connection to the desired value. Two stands are formed in this manner, which are then loaded onto a "trolley". The trolley, carrying the two stands, is hoisted onto the drill rig platform and oriented vertically. The stands are then removed from the trolley and either connected to the drill string or stored in the vertical position for later connection to the drill string.

In the prior art applicant is also aware of U.S. Pat. Nos. 6,976,540 and 6,997,265 to Berry for his Method and Apparatus for Offline Standbuilding, and U.S. Pat. No. 7,228,919 to Fehres et al. for a Pivoting Pipe Handler for Off-line Make-up of Drill Pipe Tubulars.

In the prior art of which applicant is aware, support is lacking for the length of pipe stand during hoisting from the horizontal to the vertical where the pipe stand is built horizontally in advance of hoisting.

SUMMARY OF THE INVENTION

The horizontal offline stand building system according to the present invention, herein also referred to by its acronym as a "HOSB", builds and torques, while horizontal, pipe stands of drill pipe on a double channeled deck of a catwalk, and presents the assembled triple stands to the rig floor. Each assembled or longer stand is presented to elevators suspended from the top drive of the derrick on the rig enabling drilling down of the triple or longer stands. This process removes the time delay associated with the use of prior art techniques reducing both drilling time and the possibility of down hole problems that can be caused by stopping drilling fluid circulation at connection times. Further, there is no requirement for a mousehole to handle drill pipe, thereby reducing human contact with tubulars. Included in one embodiment of the HOSB system is a V-door skate for handling of drill collars and casing. In one embodiment the HOSB system automatically straps (measures) tubular length and logs tubular and stand length in a pipe tally log. The HOSB system may also be used to lay down triple stands from the derrick for horizontal disassembly so that the triple pipe stand may then be broken down to single tubulars with a built in hydraulic wrench. This may eliminate the requirement for a conventional "lay down" unit. The HOSB system may retrofit into most existing drilling rigs.

In one aspect, the present invention provides a method of forming a stand from tubulars comprising: providing a supply of tubulars; providing substantially horizontal, elongate pipe stand forming apparatus comprising a front end, a rear, a mid section and at least one channel extending longitudinally thereover; loading a first tubular in a channel of the at least one channels on the stand forming apparatus, urging the first tubular so as to translate it longitudinally towards the rear end of the stand forming apparatus, positioning a second tubular in substantially coaxial alignment with the first tubular; rotating at least one of the first and second tubulars about corresponding longitudinal axes and in opposite directions; and, advancing the first tubular against the second tubular during the rotation whereby cooperating threads on each opposing end of the first and second tubulars are engaged to form a stand; repeating until a stand of desired length, for example a triple tubular stand is obtained, activating a lifting arm so as to elevate an upper end of the stand towards an adjacent drilling rig for mounting of the upper end to a hoist on the rig, hoisting the stand and simultaneously supporting a mid-section of the stand as the stand is hoisted by its upper end to the vertical for entrainment into the drill string.

In summary, the present invention may be characterized in one aspect as including a substantially horizontal, elongate catwalk having a frame and a stand lifting arm. The catwalk has a top surface adapted to receive at least two tubulars aligned coaxially along a linear path on said top surface. The frame has a front end, a rear end, and a mid section. The stand lifting arm is a selectively actuable lifting arm for selectively elevating a rig end of a pipe stand from said the top surface of the catwalk.

A selectively actuable means for urging the tubulars along the top surface between the front and rear ends is provided so as to urge ends of successive tubulars together into an end-to-end mating position. A rotating means is provided for urging relative rotation of tubulars when in the end-to-end position about their corresponding longitudinal axes so as to threadably engage the end-to-end positioned tubulars together to form at least one section of a completed pipe stand. Preferably at least a triple stand is formed.

Means are also provided for translating the completed pipe stand so as to position the pipe stand over said lifting arm. Means are also provided for selectively actuating the lifting arm to lift and translate the completed pipe stand so as to position the rig end of the pipe stand into a hoisting position adjacent a drilling rig derrick.

In a preferred embodiment the lifting arm includes an arm member and a selectively actuable clamp mounted on said arm member so as to selectively hold in place the rig end of the pipe stand. Thus, during an initial lifting of the pipe stand, the rig end of the pipe stand is held in place relative to said arm member by the clamp so as to translate the pipe stand towards the derrick by the actuation of the said lifting arm. The arm member may be a parallel laterally spaced apart pair of elongate arms. A carriage which may be adopted to be selectively positioned along the length of the arm member, for example running between the pair of arm members in such an embodiment, advantageously includes a means such as the clamp, for grasping the pipe stand at a position along the length of the pipe stand.

Advantageously the clamp is mounted on the carriage and the carriage is mounted on the arm member of the lifting arm and adapted so as to be selectively positionable along the arm member. Advantageously the carriage is pivotally mounted for rotation about a lateral axis of rotation thereby providing for relative angular rotation between the pipe stand and lifting arm. The carriage may also include rollers to allow relative longitudinal motion of the pipe stand relative to the lifting arm.

In one embodiment, the arm member has a base end and an opposite distal end, and the base end is pivotally mounted to the frame. A selectively actuable actuator selectively rotates said arm member about the base end between a lowered position, a vertical position, and a delivery/pickup position opposite said lowered position in an arc lying in a substantially vertical plane parallel with the linear translation path of the tubulars and stand.

The linear path on the top surface of the said catwalk includes at least one channel adapted to receive the tubulars. The arm member of the lifting arm is coextensive with at least a portion of one channel when said arm member is in its lowered position. The arm member may be flush with that channel when the arm member is in the lowered position. In one embodiment the at least one channel includes a substantially parallel pair of channels. The pair of channels include a make up channel and a delivery channel. The arm member is mounted so as to cooperate with the delivery channel. In this embodiment selectively actuable lateral translators are provided for selectively laterally translating the pipe stand, once assembled, from said make-up channel to said delivery channel.

A method according to a further aspect of the present invention includes the steps of:

(a) providing a supply of tubulars;
(b) providing an elongate stand forming frame having a top surface front end, rear end and mid section, wherein the top surface is adapted to receive at least two tubulars aligned coaxially along a linear path on the top surface,
(c) providing an actuable lifting arm adjacent the front end for selective raising and translation of a pipe stand of tubulars along the linear path and over the front end and providing selectively actuable means for urging tubulars along the linear path;
(d) loading a first tubular onto the linear path between the front and rear ends;
(e) urging the first tubular towards the rear end;
(f) loading at least a second tubular onto the linear path between the first tubular and the front end, wherein the second tubular and successive tubulars are positioned in succession along the path;
(g) rotating the first and second tubulars relative to one another while urging then together so as to threadably couple the first and second tubulars, and then rotating any subsequent tubulars relative to the first and second tubulars about their longitudinal axes while urging together the subsequent tubulars with the first and second tubulars so as to form the pipe stand;
(h) urging the pipe stand so as to position the pipe stand over the lifting arm;
(i) elevating the lifting arm;
(j) translating the pipe stand while elevating the pipe stand on the lifting arm to position a rig end of the pipe stand adjacent a derrick for hoisting of the pipe stand up the derrick.

The method may further include the steps of holding the rig end of the pipe stand in place on the lifting arm and initially lifting the rig end of the pipe stand while held in place by the clamp, and actuating the lifting arm so as to translate the pipe stand.

The method may also include the step of selectively positioning the carriage along the arm member so as to optimize maintaining for as long as possible support of the weight of the pipe stand by the carriage as the pipe stand is hoisted up the derrick.

The method may also include the step of selectively rotating the arm member about its base end between a lowered position, a vertical position, and a delivery/pickup position opposite the lowered position in an arc lying in a substantially vertical plane parallel with said linear path so as to optimize the support of the weight of the pipe stand.

The method may also include the step of rotating the arm member to thed lowered position prior to loading of a rig end tubular.

The method may further include the steps of making up a first pipe stand in said make up channel independently of delivery of a second pipe stand by said lifting of the second pipe stand from said delivery channel by said lifting arm, and, once delivered, laterally translating the first pipe stand from the make up channel to the delivery channel by means of selectively actuable lateral translators which laterally translates a pipe stand, once assembled in said make up channel, from said make-up channel to said delivery channel when said delivery channel is empty. Once laterally translated to the delivery channel, a third pipe pipe stand may be made-up in the make up channel, and so on.

In the method according to the present invention the steps of maintaining of support of the weight of the pipe stand may be optimized by the further steps including:

(a) lowering the carriage along the arm member to a lowered position for the initial lifting of the rig end of the pipe stand, (b) rotating said aim member in an arc from the lowered position to the delivery/pickup position with the carriage in the lowered position and the holding in place of the rig end of the pipe stand during the rotation to the delivery/pickup position, (c) releasing the rig end of the pipe stand from the carriage when the arm member is in said delivery/pickup position for hook-up of the rig end of pipe stand to a hoist on the derrick, (d) during hoisting by the hoist of the pipe stand towards the vertical, elevating the carriage towards the distal end of the arm member and returning the arm member along its arc towards the vertical position and the lowered position.

(e) during the hoisting of the stand, allowing the pipe stand to run along its length through the clamp on the carriage.

(f) once the pipe stand has run substantially at least half of its length through said clamp on the carriage then once again returning the arm member along the arc towards the delivery/pickup position, and with the carriage positioned at the distal end of the arm member, supporting the lower end of the pipe stand until hoisted clear of the arm member.

BRIEF DESCRIPTION OF THE DRAWINGS

The features of the invention will become more apparent in the following detailed description in which reference is made to the appended drawings where similar characters of reference denote corresponding parts in each view.

DETAILED DESCRIPTION OF EMBODIMENTS OF THE INVENTION

Figure 1:
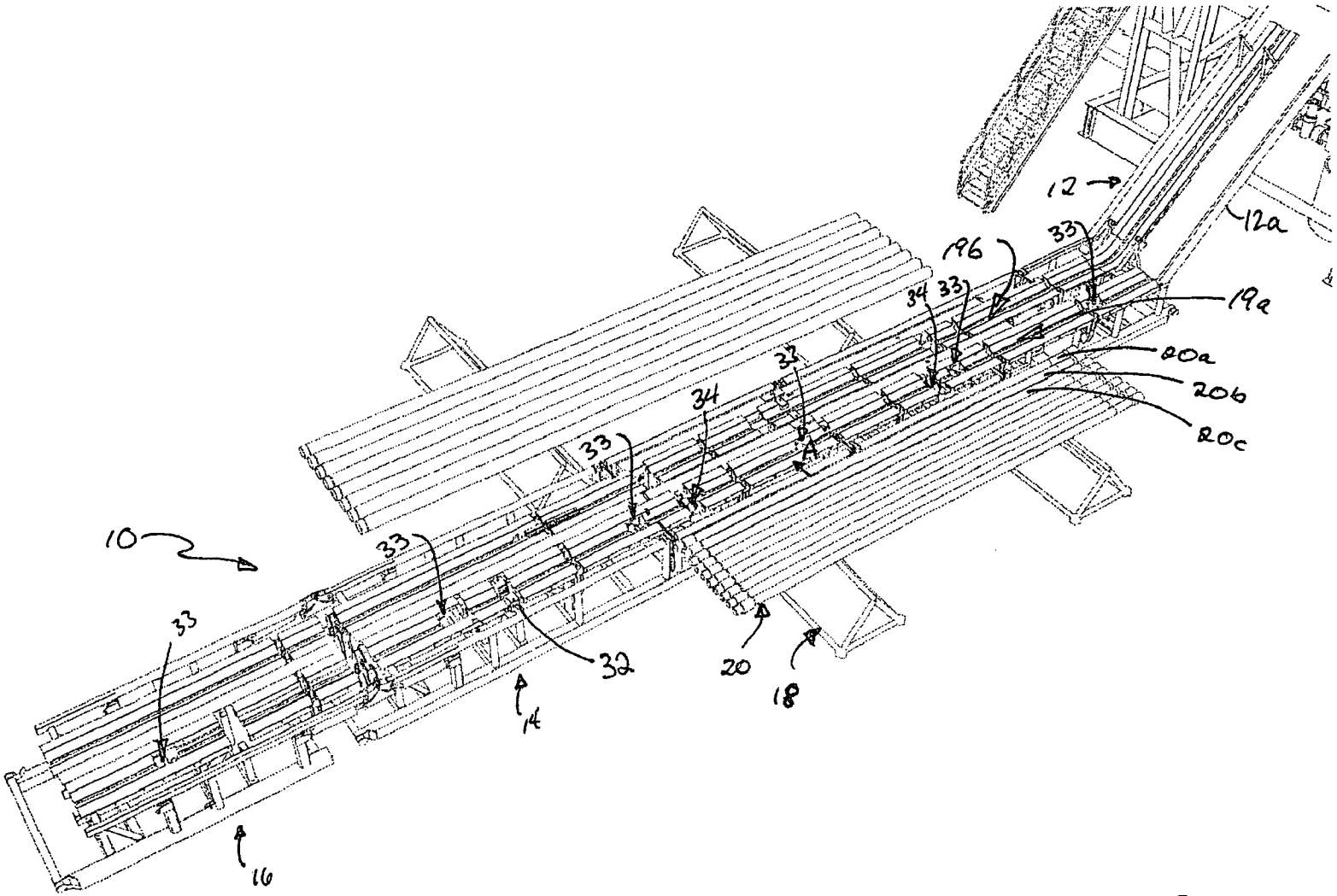
FIG. 1 is, in top perspective view, a catwalk according to one embodiment of the present invention illustrating tubulars supported on a stand ready for singulating into a makeup channel on the catwalk.
Figure 2:
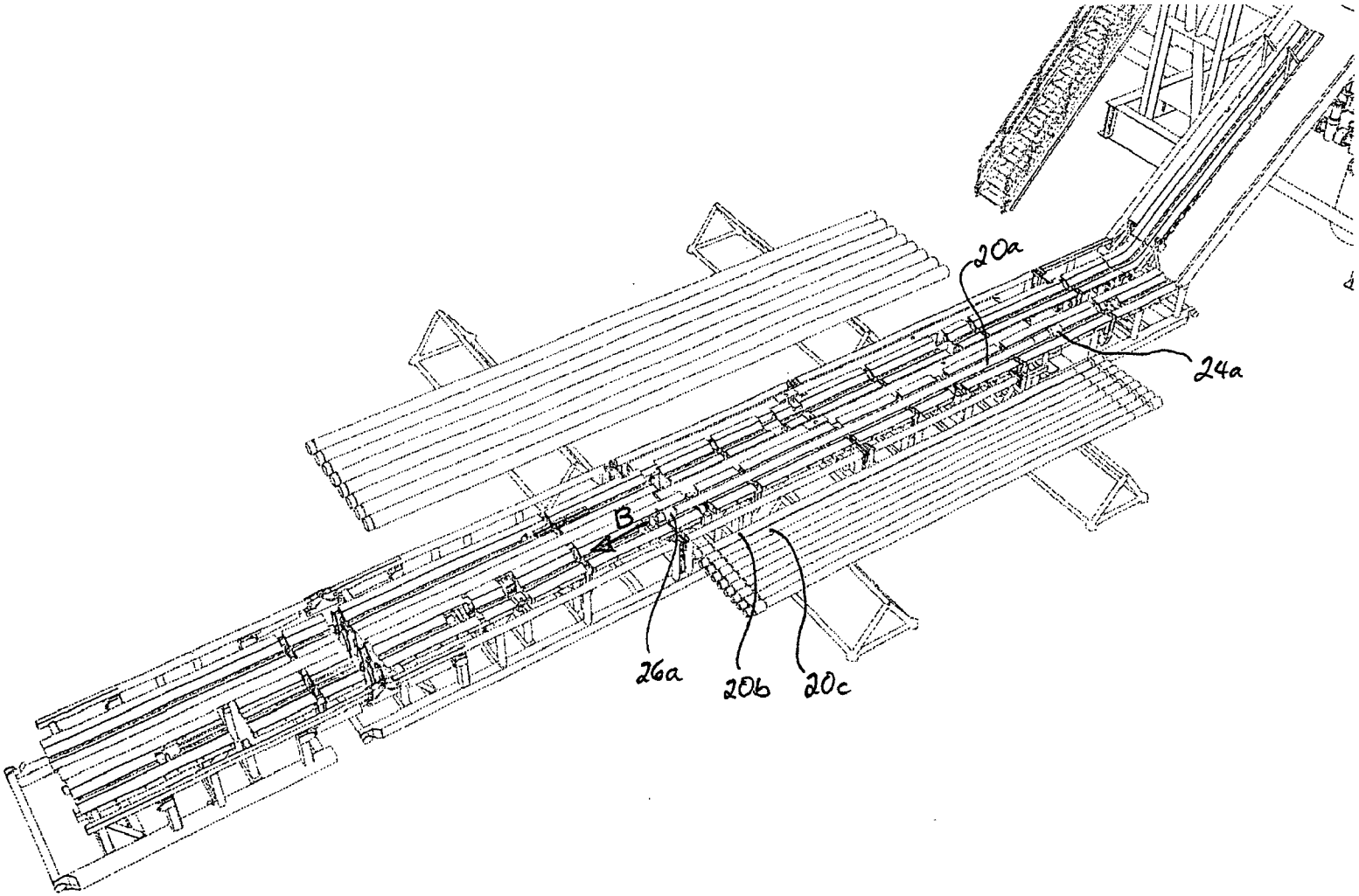
FIG. 2 is a view of figure one illustrating a first tubular having been singulated from the stand into the makeup channel at the loading station of the catwalk.
Figure 3:
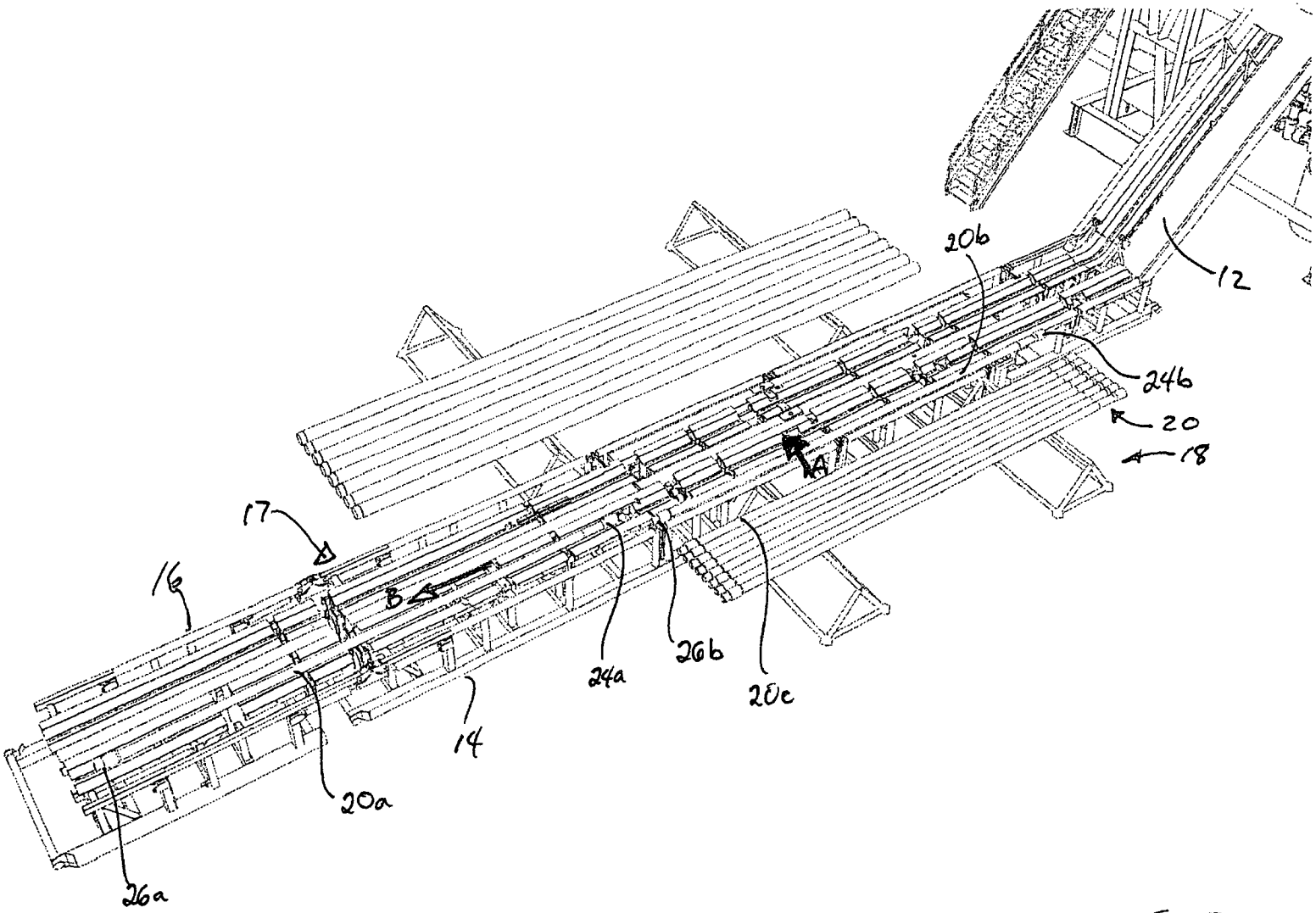
FIG. 3 is the view of figure two illustrating the first tubular having been translated rearwardly in the makeup channel and the second tubular being singulated into the makeup channel at the loading station.
Figure 4:
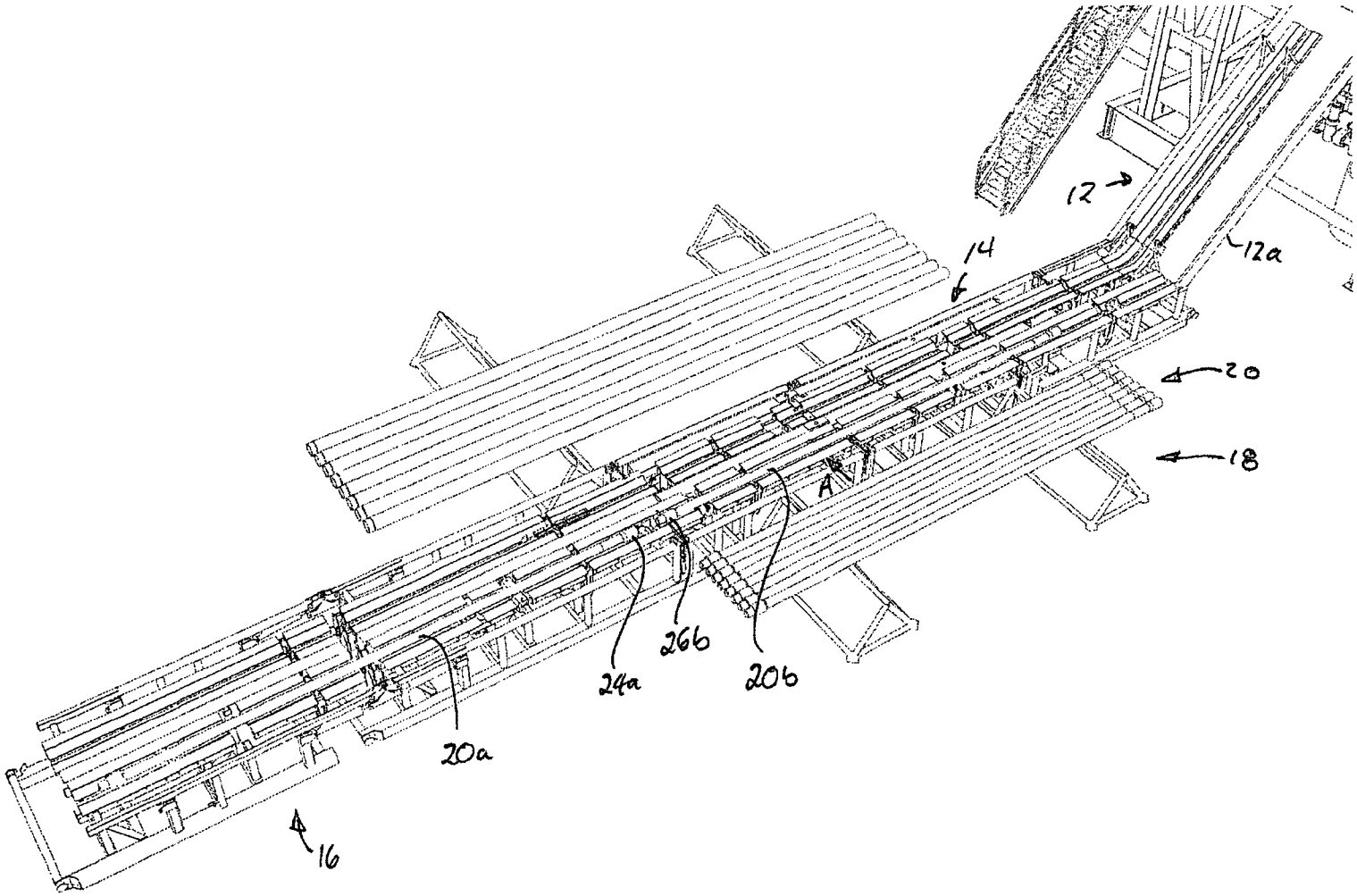
FIG. 4 is the view of FIG. 3 illustrating the second tubular having been loaded into the makeup channel so as to align with the first tubular.
Figure 5:
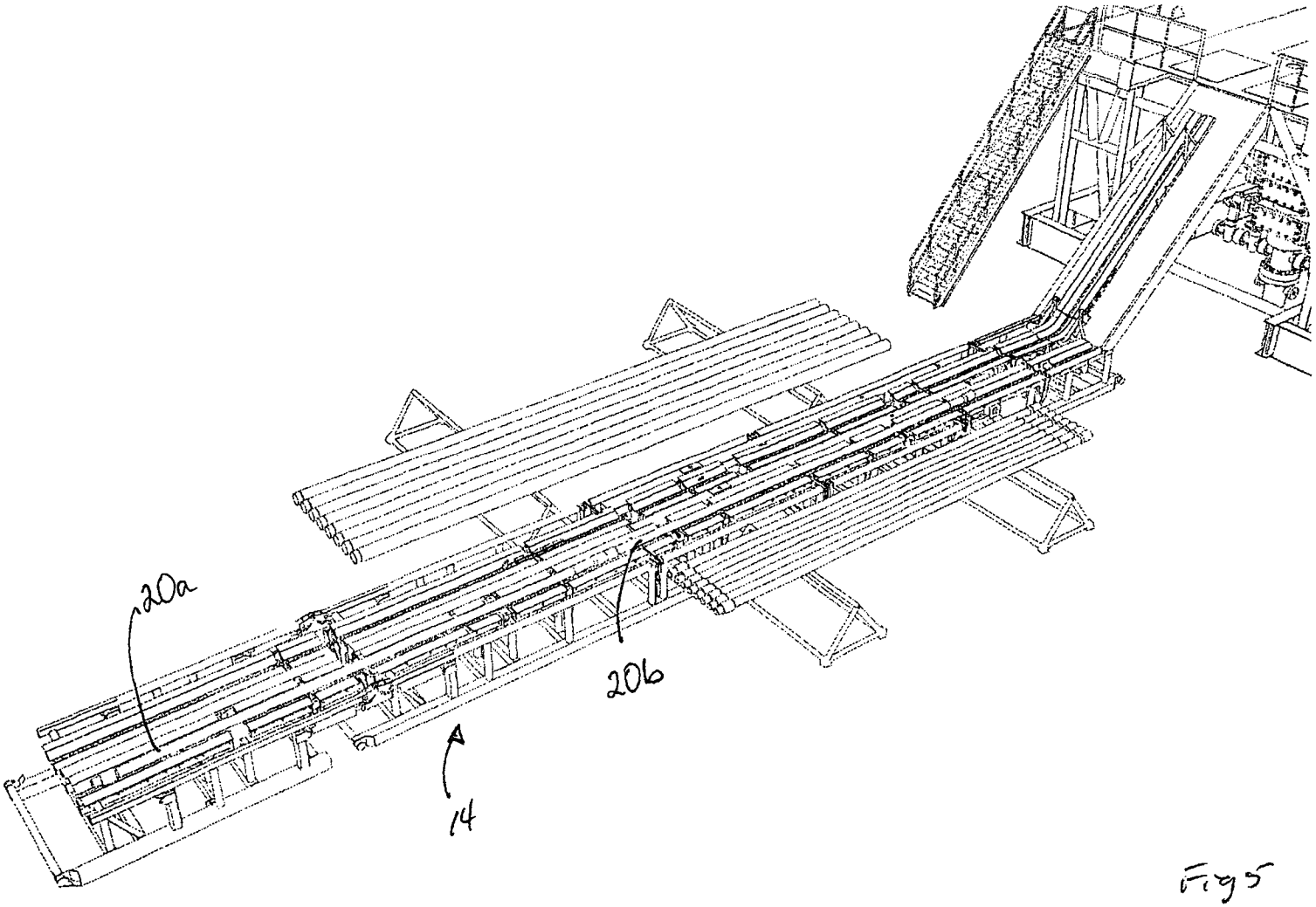
FIG. 5 is the view of FIG. 4 illustrating the first tubular having been clamped in the makeup channel and the second tubular having been urged rearwardly against the first tubular and rotated as to makeup the joint between the first and second tubulars.
Figure 6:
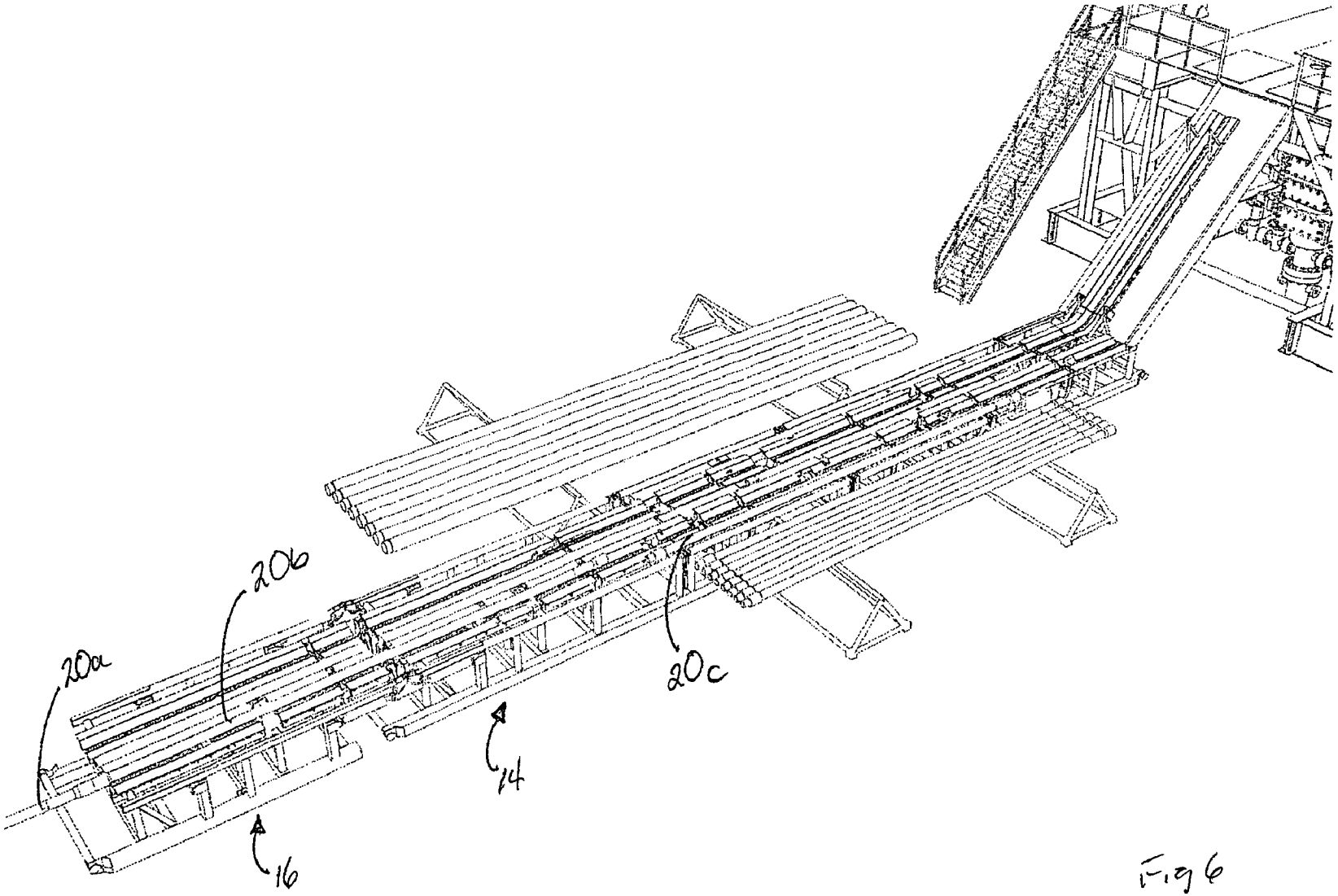
FIG. 6 is the view of FIG. 5 illustrating the double pipe stand containing the first and second tubulars having been translated rearwardly and the third tubular having been singulated from the rack for loading into the makeup channel and for making up of the joint between the second and third tubulars so as to form a triple pipe stand in the makeup channel.
Figure 6A:
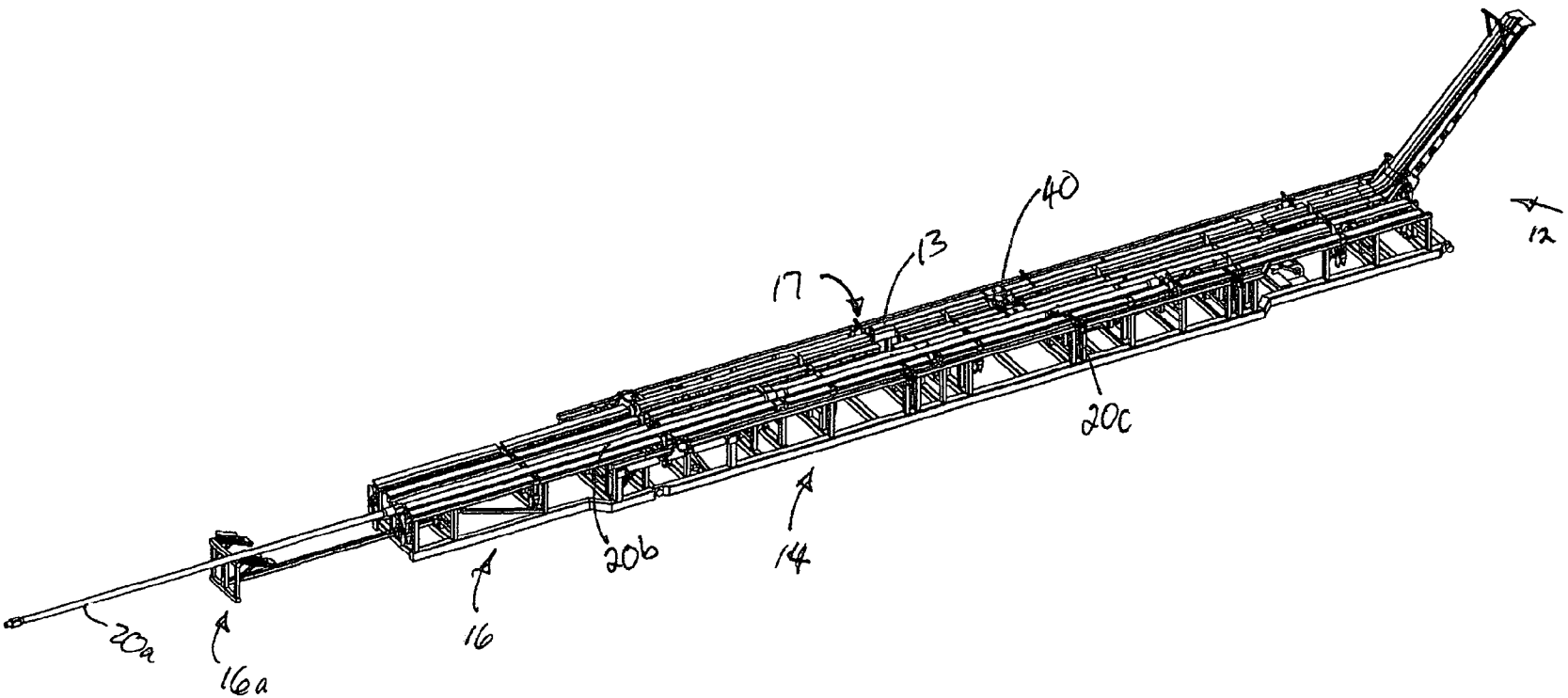
FIG. 6*a* is, in top perspective view, and alternative embodiment of the catwalk of FIG. 6 illustrating the triple stand, once made up, being supported at its rearward end on a telescopically extending support where the first tubular extends rearwardly from the rear end of the catwalk.
Figure 7:
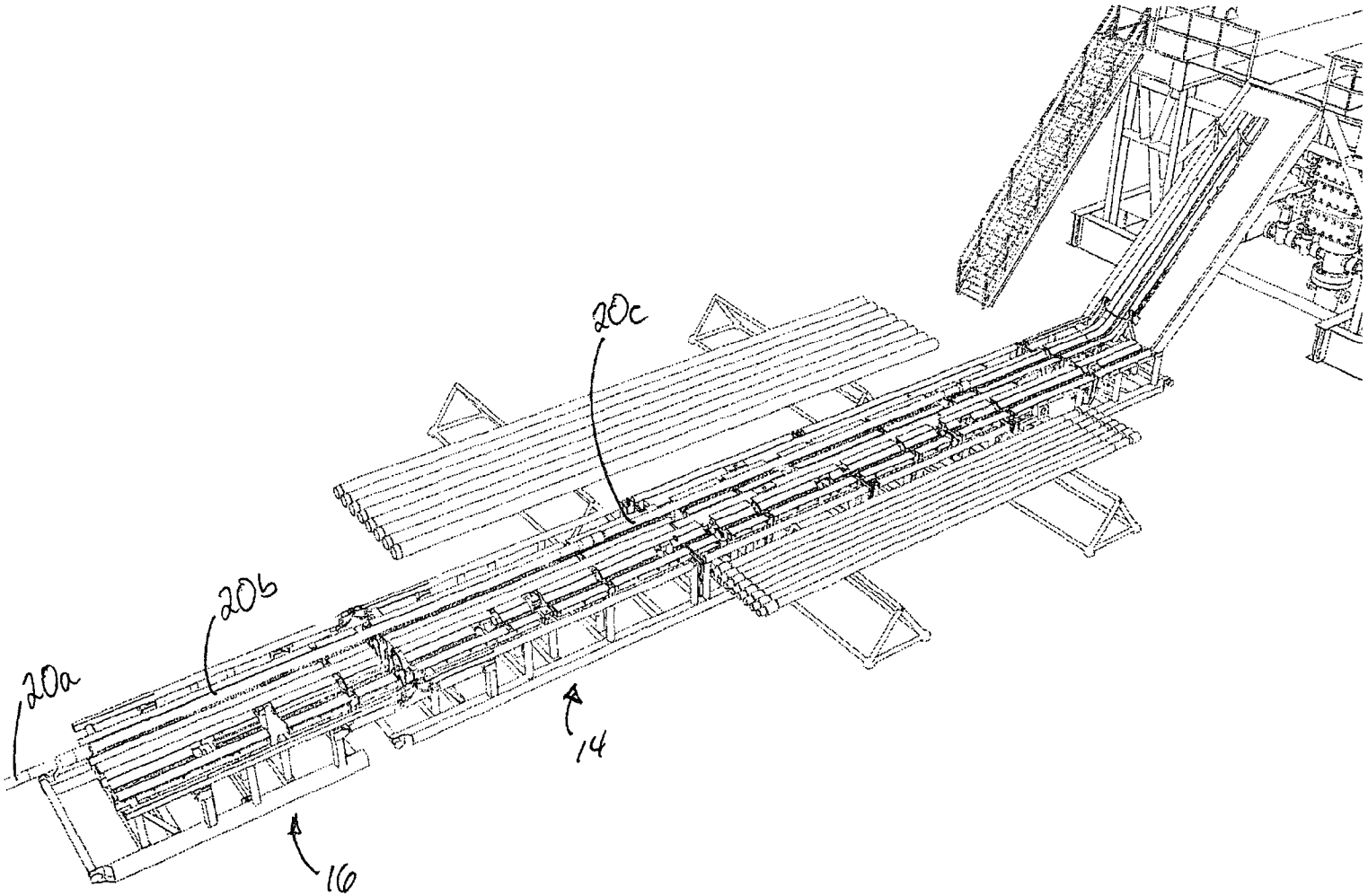
FIG. 7 is the view of FIG. 6 illustrating the triple stand having been translated laterally from the makeup channel to the delivery channel on the catwalk.
Figure 7A:
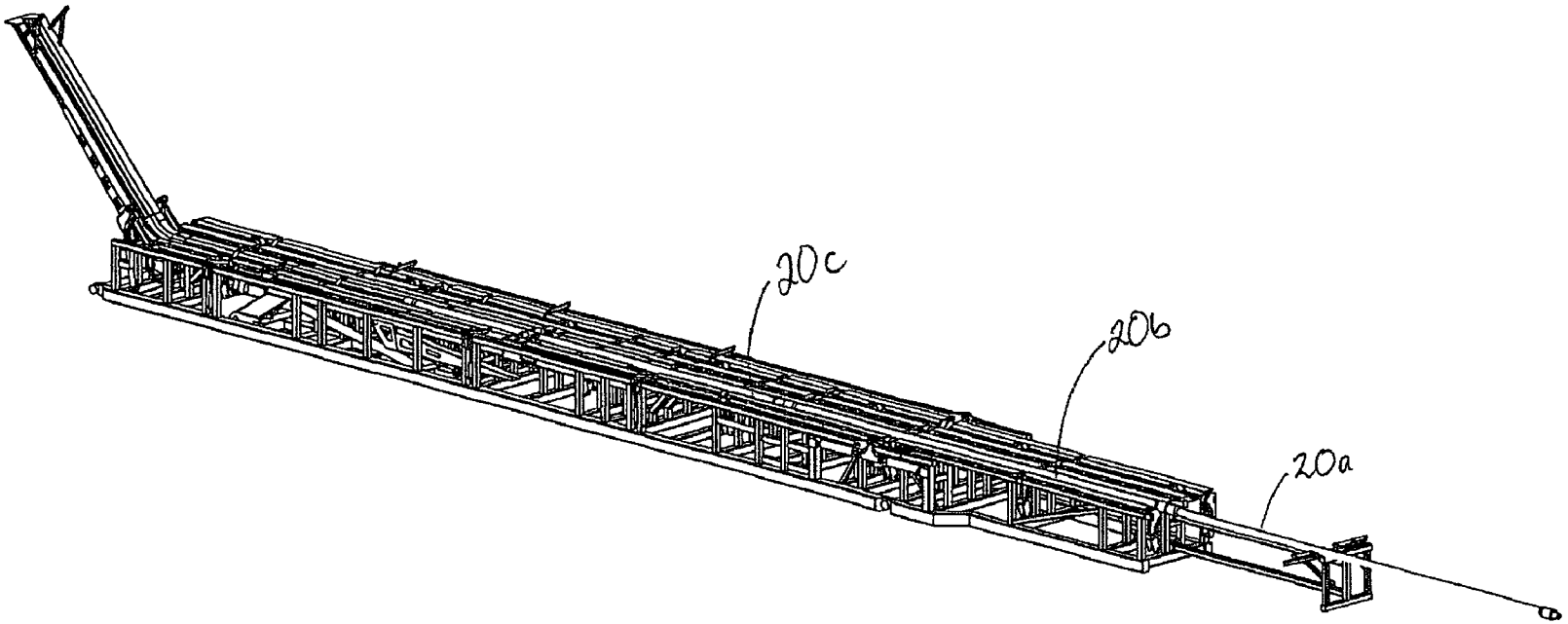
FIG. 7*a* is, in perspective view, the catwalk of FIG. 6*a* viewed from its opposite lateral side and illustrating the triple pipe stand supported in the delivery channel and on the telescopic support.
Figure 8:
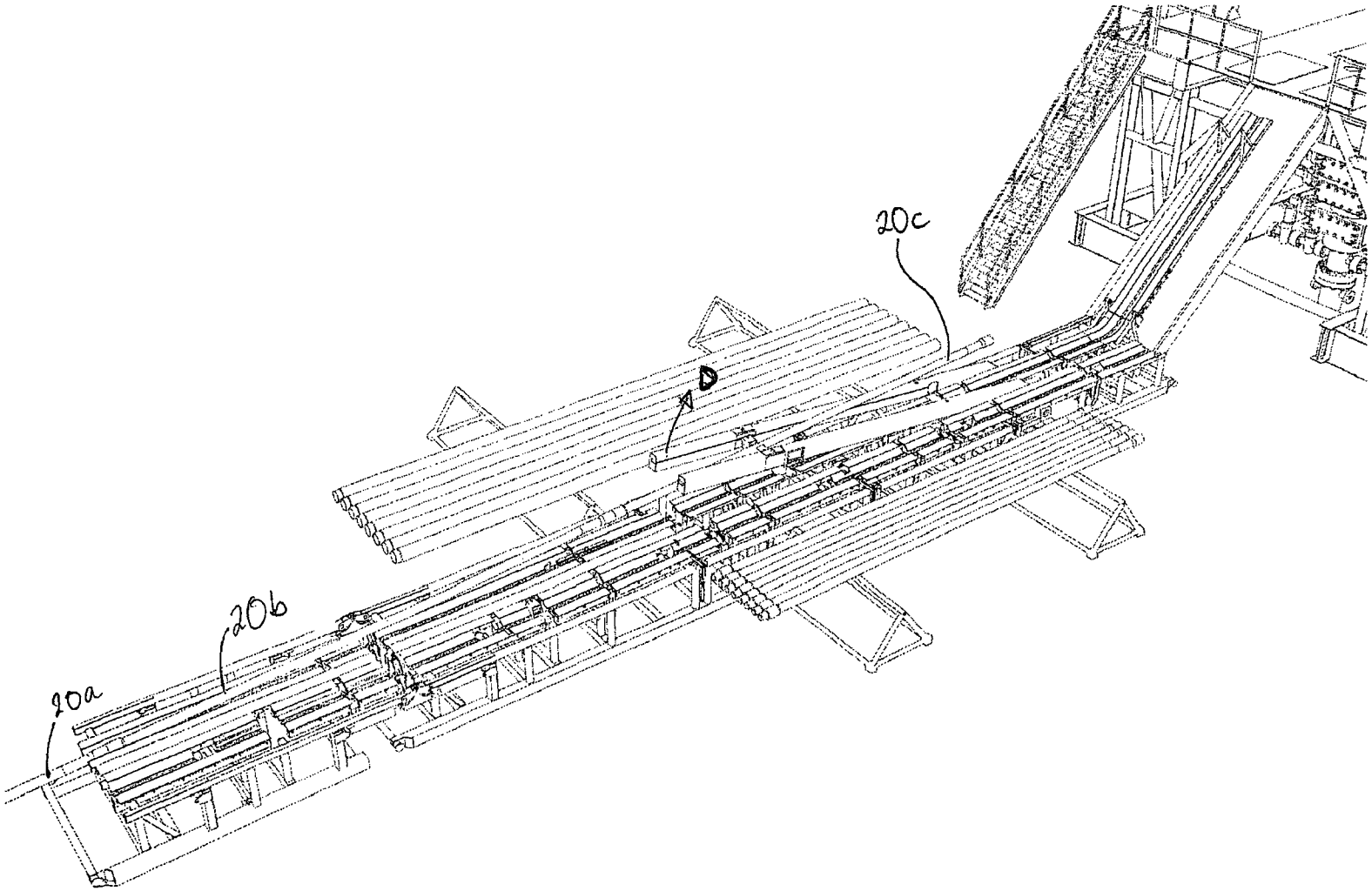
FIG. 8 is the view of FIG. 7 illustrating the lifting arm commencing upwardly rotation so as to engage its carriage under the third tubular of the triple pipe stand thereby initially lifting the triple pipe stand from the delivery channel.
Figure 8A:
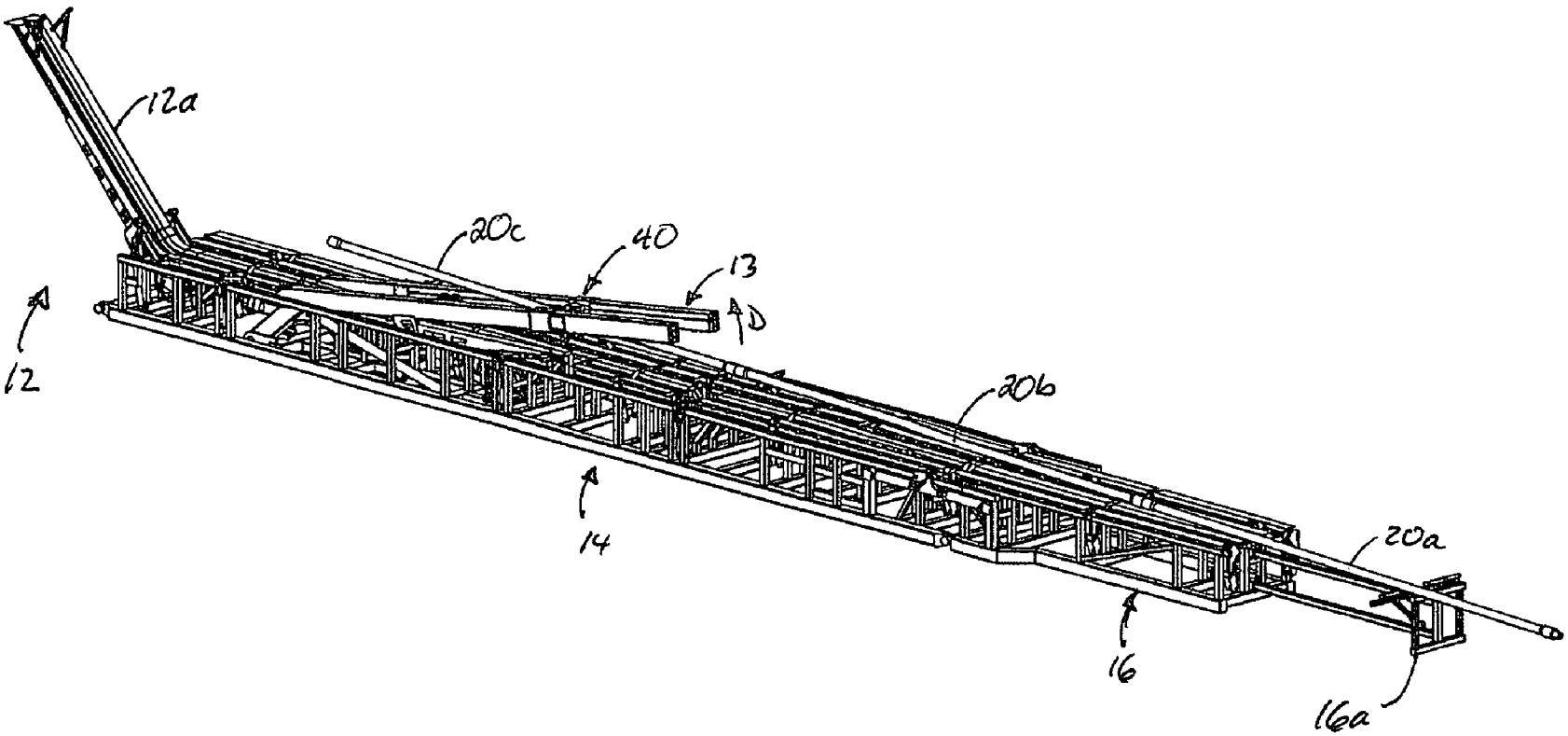
FIG. 8*a* is the view of FIG. 7*a* illustrating the initial lifting of the lifting arm so as to engage the triple pipe stand.
Figure 9:
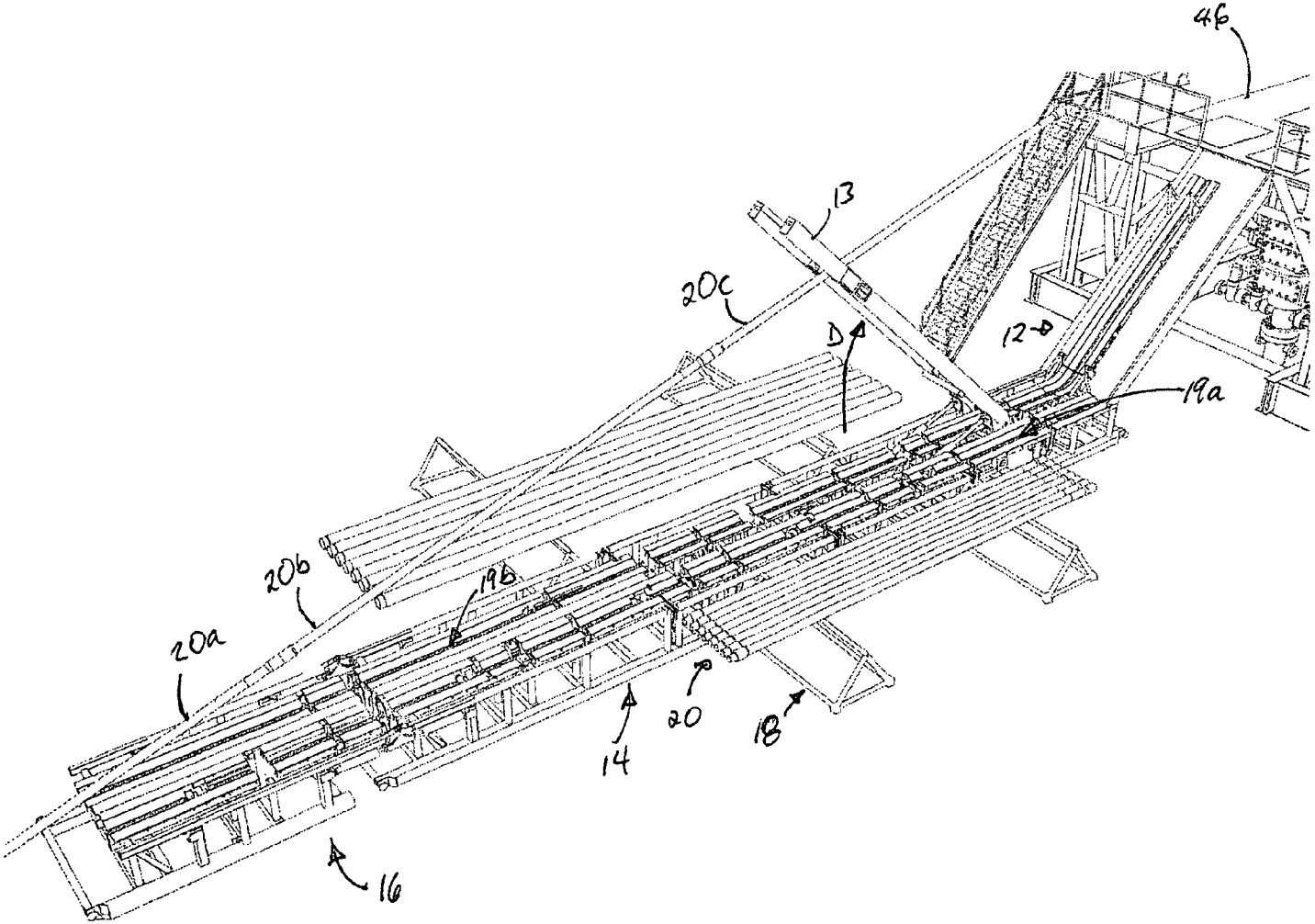
FIG. 9 is the view of FIG. 8 illustrating the lifting arm continuing to rotate upwardly under the third tubular thereby continuing to elevate the triple pipe stand from the delivery channel.
Figure 9A:
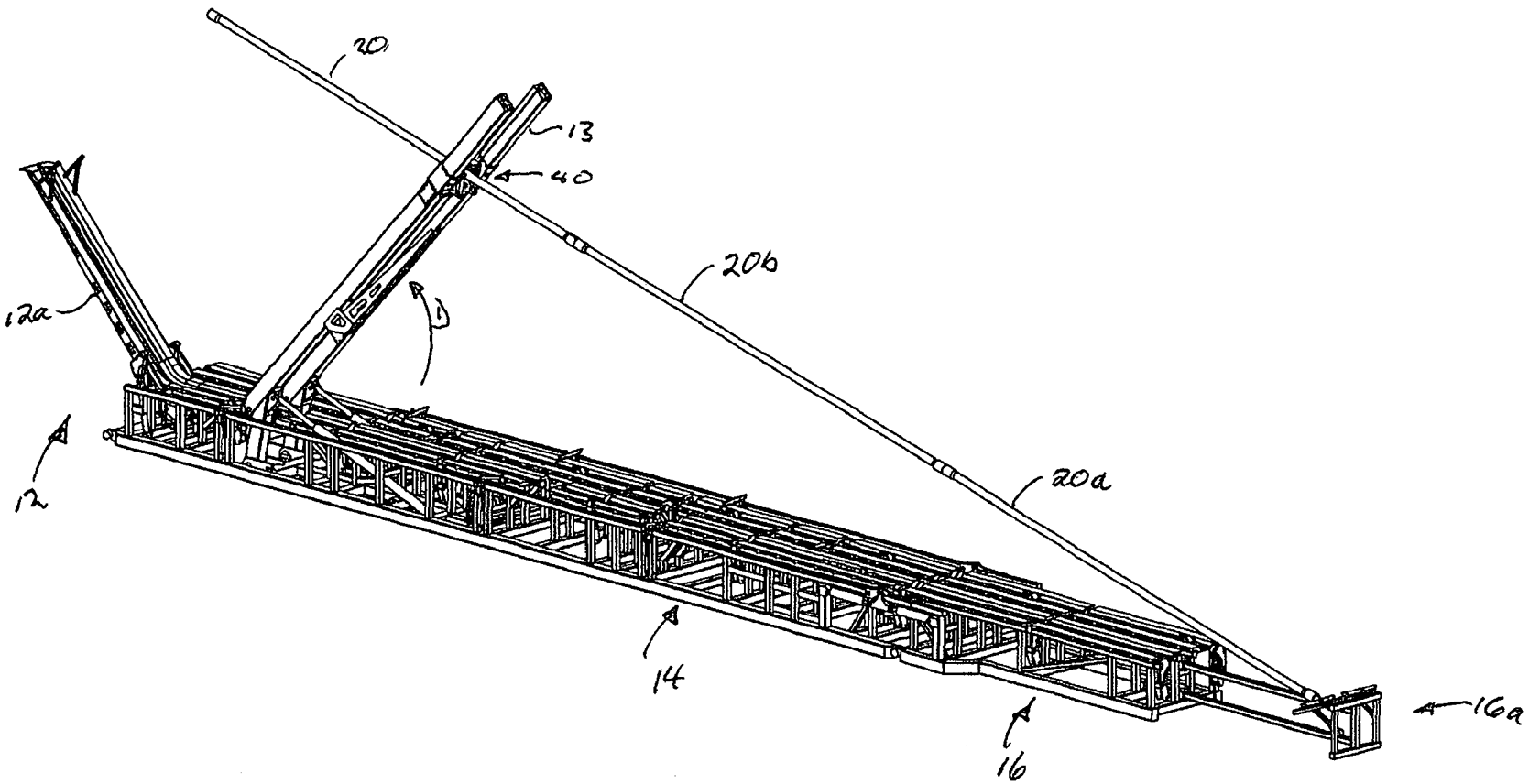
FIG. 9*a* is the view of FIG. 8*a* illustrating the lifting arm continuing to lift the triple pipe stand from the catwalk.
Figure 10:
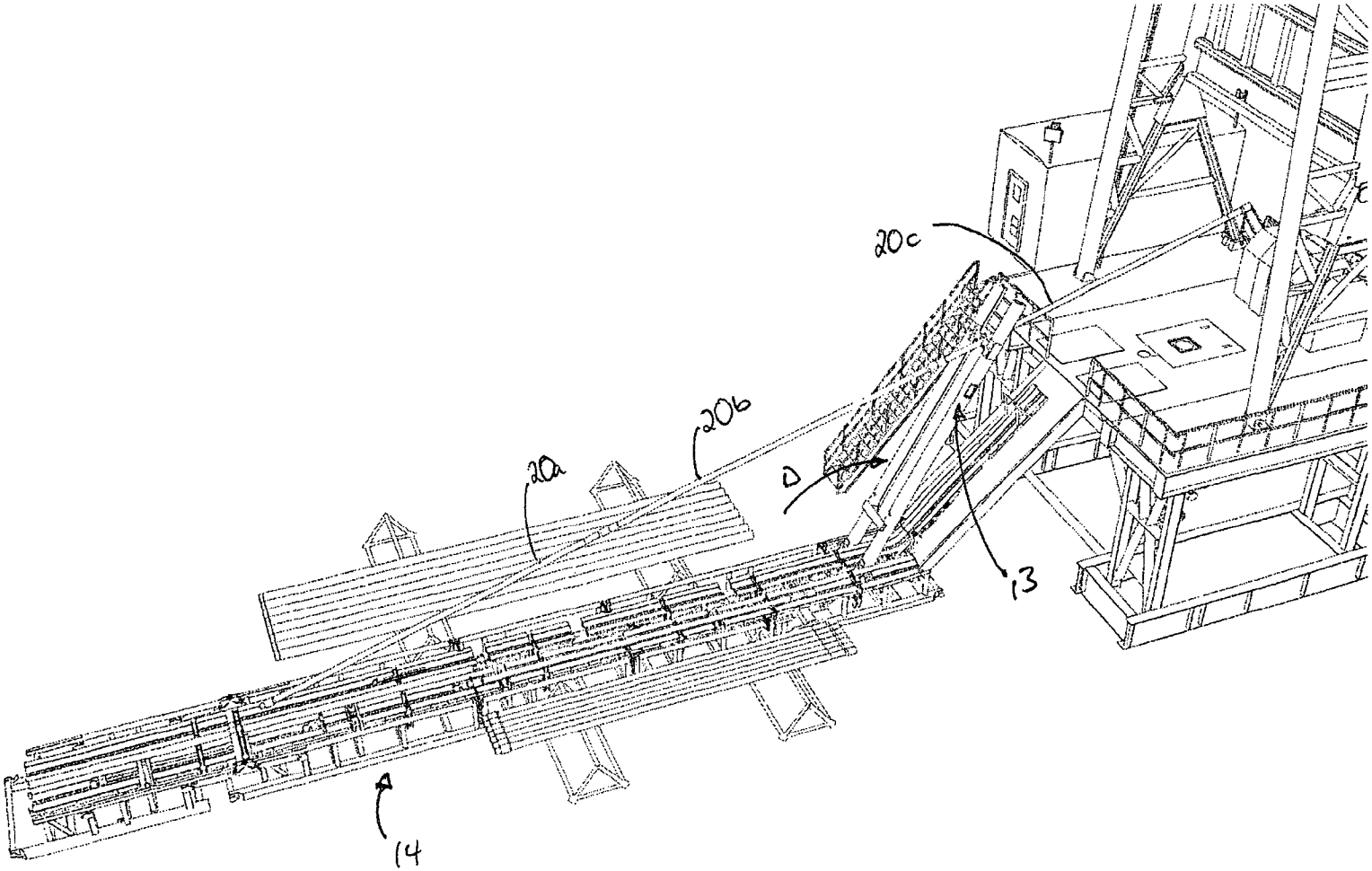
FIG. 10 is the view of FIG. 9 illustrating the lifting arm having been rotated through the vertical and into a delivery orientation while supporting the third tubular, the triple pipe stand having been lifted from the delivery channel and translated longitudinally so as to present the forward end of the triple pipe stand over the drilling rig platform waiting mounting to the derrick hoist.
Figure 10A:
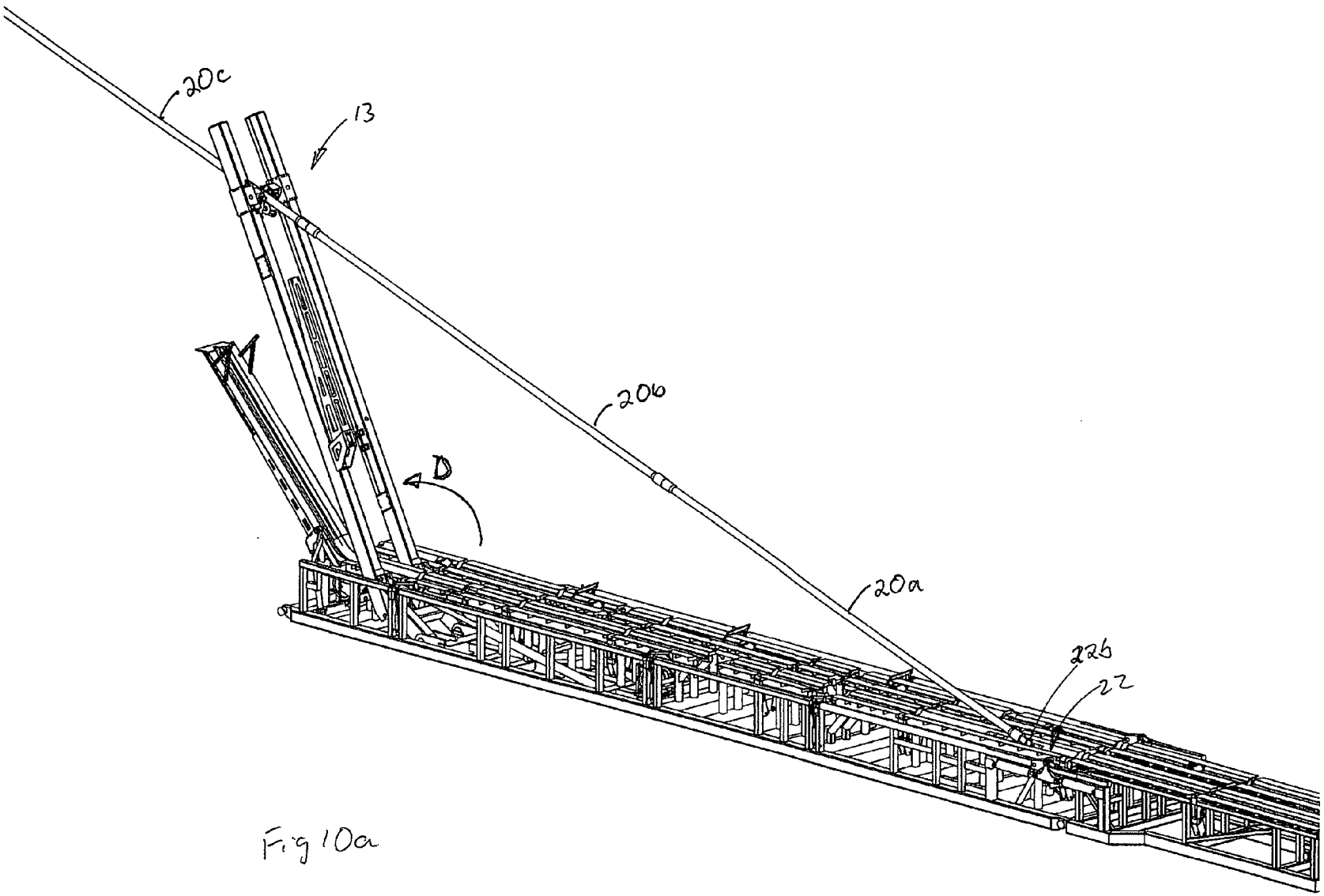
FIG. 10*a* is the view of FIG. 9*a* showing the lifting arm having rotated through the vertical into a delivery position while supporting the third tubular of the triple pipe stand, the triple pipe stand having been lifted out of the delivery channel and translated longitudinally toward the derrick
Figure 11:
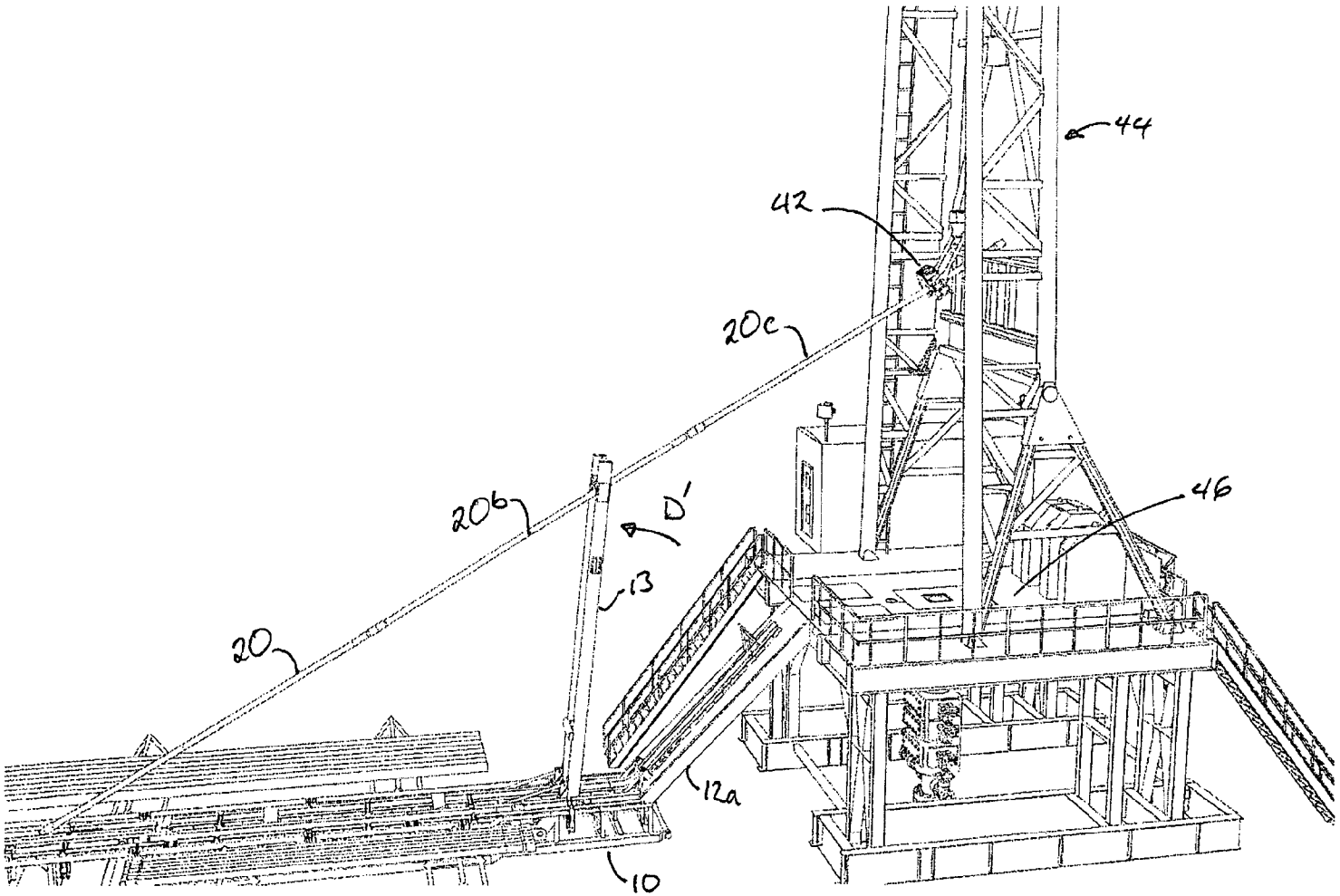
FIG. 11 is the view of FIG. 10 illustrating the triple pipe stand being initially hoisted by the hoist on the derrick and the lifting arm having returned from its delivery position to the vertical so as to support the second tubular in the triple pipe stand.
Figure 11A:
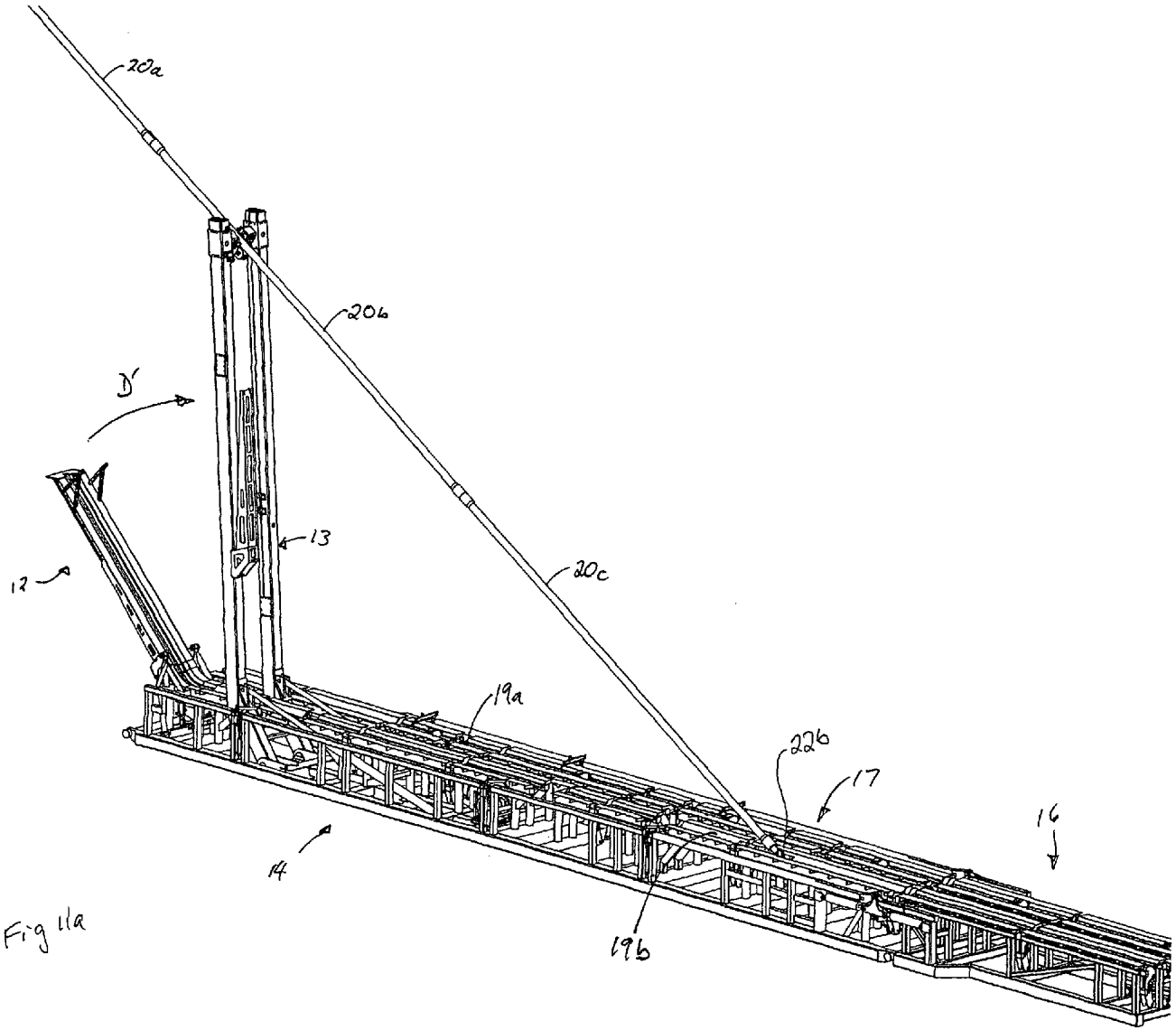
FIG. 11*a* is the view of FIG. 10*a* illustrating the lifting arm having returned to the vertical from its delivery position so as to support the mid portion of the triple pipe stand as it is being hoisted from the delivery channel.
Figure 12:
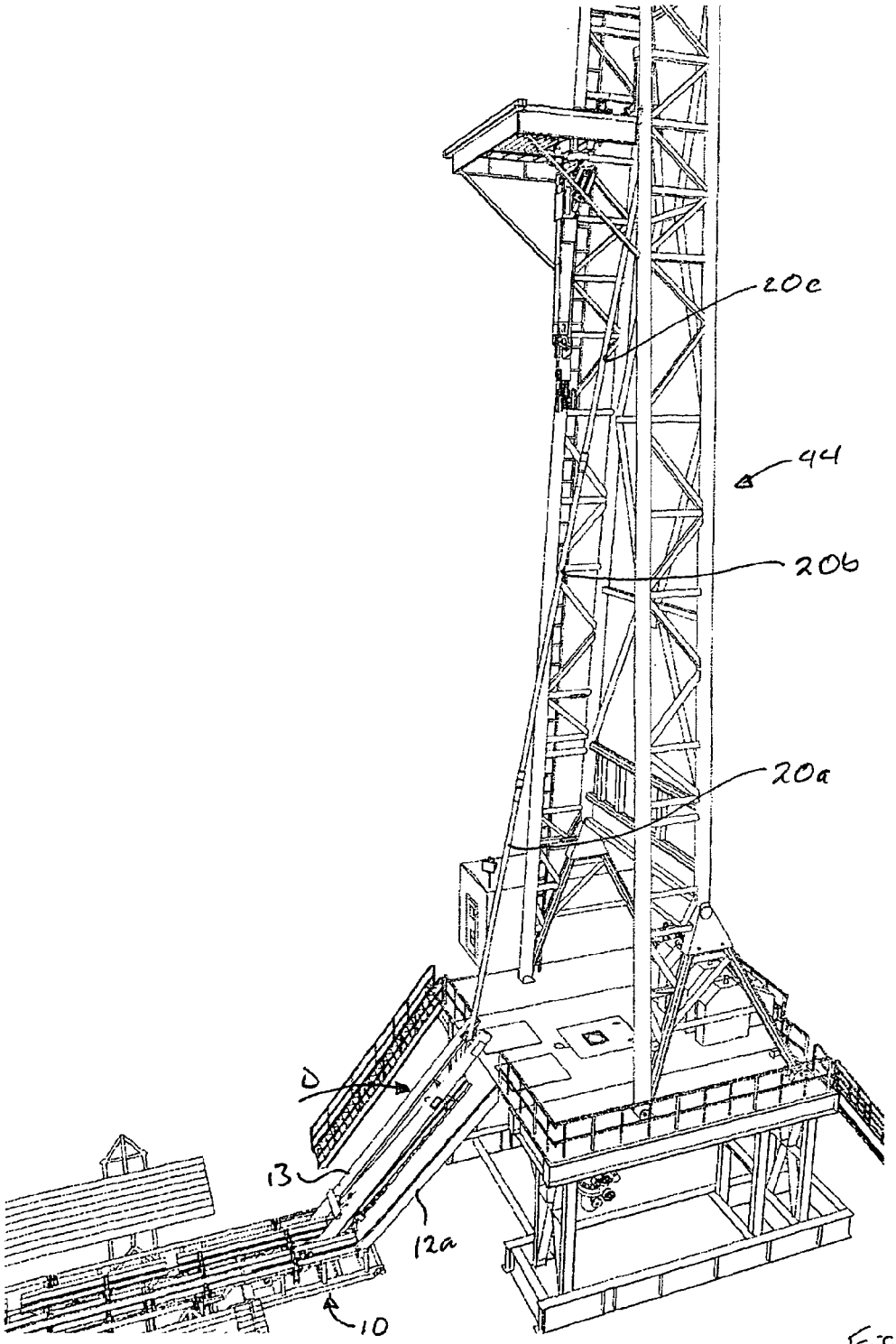
FIG. 12 is, in perspective view, the forward end of the catwalk according to one embodiment of the present invention and the drilling rig platform and derrick illustrating the triple pipe stand having been almost completely hoisted to the vertical up the derrick to the point where the rear end of the triple pipe stand, now the lower most end of the triple pipe stand is about to disengage from the uppermost end of the lifting arm, the carriage having been elevated to the uppermost end of the lifting arm posts so as to only release the triple pipe stand at a position most closely to the vertical.
Figure 13:
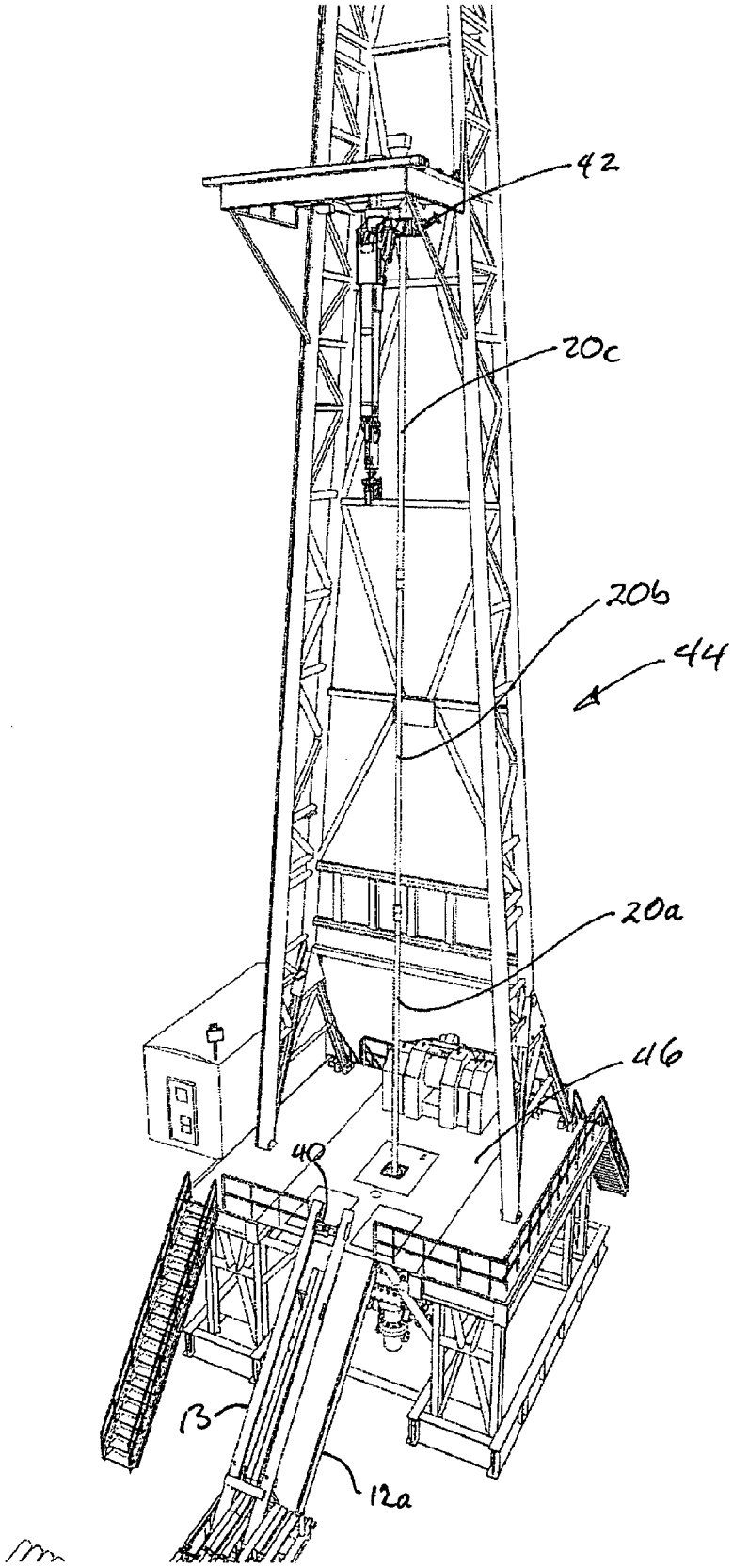
FIG. 13 is, in perspective view, the drilling rig of FIG. 13 illustrating the triple pipe stand having been hoisted to the vertical and then made up with the drill string.

The features of the invention will become more apparent in the following detailed description in which reference is made to the appended drawings where similar characters of reference denote corresponding parts in each view:

As described further below in more detail, the present invention provides an improved apparatus for forming pipe stands from individual tubulars. In general, the invention may include a catwalk having a first channel 19*a* onto which are first loaded two tubulars 20*a* and 20*b*. The first channel 19*a* is a stand make-up channel in which a pipestand is assembled, or dissembled as the case may be. During assembly of the stand the tubulars are positioned coaxially in first channel 19*a* in an end-abutting arrangement, having been loaded from laterally adjacent racks 18 where the tubulars are stored. Kickers 38 known in the art singulate the individual tubulars from rack 18 into the first channel 19*a*. That is, the catwalk is provided with lifting and/or singulating devices of known kind cooperating with adjacent racks on which a array of tubulars are stored side-by-side. Tubulars are fed from the rack and singulated into the first channel. Rollers 33 in the first channel 19*a*, driven by one or more motors, are arranged so that an end-to-end pair of axially aligned tubulars 20*a* and 20*b* may be rotated about their longitudinal axes relative to one another by driven rollers 34*a*. During the rotation, the tubulars are advanced against each other whereby the complementary threads on each opposed facing end engage to form a connection, thereby forming a dual tubular stand. As will be understood, the tubulars are arranged so that the opposed facing ends are male and female ends which are urged by rollers 33 into abutting arrangement so as to permit engagement. Further tubulars may be threaded onto the two-tubular stand to form stands of three, four etc. tubulars threaded together end-to-end to form a single long pipe stand, for example a triple stand of tubulars 20*a*, 20*b*, and 20*c*, resting in first channel 19*a* in the catwalk.

Once a stand of desired length is assembled, the stand is then transferred laterally into a parallel adjacent second channel 19*b* and pushed by skate 22 towards the forward or front end 12 of the catwalk, and thus towards the drilling rig. A ramp 12*a* provided either on the catwalk or on the rig and a lifting arm 13 on the catwalk causes the end of the stand closest to the drilling rig to be raised and forwardly translated. The skate may assist in pushing the stand. The stand is lifted and translated forwardly until a hoist on the drill rig can engage the rig end of the stand and pull the stand from its inclined position with the rig end raised to the desired vertical position over the drilling platform. As the stand is elevated by its rig end up the derrick, lifting arm 13 is rotationally positioned to support, firstly, the mid section 14 and then the rig rear end 16 of the stand. If mid section 14 of the stand was not so supported, for example if the mid section of a triple stand was not supported, the stand might bend excessively under its own weight until it permanently deformed or buckled. The stand can then be stored or immediately connected to an existing drill string. Rear section 16 may be folded to facilitate transport. A telescopically extending extension support 16*a* may be extended from rear section 15 to support the end of stand extending cantilevered off the rear end of the catwalk.

Catwalk 10 includes a frame. The structure of the frame may include trusses having comprise struts and support members and the like. As will be understood by persons skilled in the art, various structures for the frame are possible. In one embodiment, catwalk 10 is adapted to rest on the ground; however, in other embodiments, the apparatus may include tracks, wheels or other such devices upon which the frame rests.

Lifting arm 13 cooperates with the catwalk and ramp and may be actuated to rotate upwardly from the catwalk. Lifting arm 13 raises the rig end of the tubular or stand resting thereon so that it may be grasped by a hoist or similar device provided on the drill rig.

The catwalk 10 includes a top surface 17 which receives tubulars in a pair of parallel first and second channels 19*a*, and 19*b*, respectively, which may be formed as grooves, or "V" or "U" shaped surfaces for locating the tubular or stand in a desired location therein. Channel 19*a* is a pipe stand make-up channel. Channel 19*b* is a pipe stand transfer or delivery channel for loading stands onto the derrick, and unloading stands from the derrick. Various other tubular/stand retaining means for retaining tubulars on the top surface 17 will be known to persons skilled in the art. It will be understood that such retaining means serve to prevent tubulars or stands from rolling or other such unwanted movements.

In operation, the catwalk apparatus 10 is first positioned adjacent a drilling rig such that the catwalk extends generally perpendicularly from the rig and such that the front end section 12 is adjacent the rig floor. The front end section 12 is inclined upwards so that its upper end is approximately at the level of drilling platform of the rig.

A supply rack 18 containing a supply of tubulars 20 is positioned to the catwalk 10. The tubulars 20 are preferably provided in a generally parallel arrangement on the rack 18. As discussed above, the tubulars, as commonly known in the art, are pipes each having opposite male and female ends, each provided with complementary threads. Thus, in a preferred embodiment, the tubulars 20 on the rack 18 are arranged so that all of the respective male, or as-called pin ends and female ends are positioned in the same orientation. More preferably, in order to facilitate the present method, the tubulars are oriented such that all female ends, are pointed towards the catwalk front end 12, that is, pointed towards the drilling rig.

The supply rack 18 is positioned closely adjacent to the mid-section 14 of catwalk 10 so as to facilitate transfer in direction A of tubulars 20 from the rack 18 to the catwalk 10. In one embodiment, the catwalk 10 and rack 18 are arranged so as to allow a tubular to roll from the rack onto the top surface 17 of the catwalk 10. As will be understood, in such arrangement, the catwalk top surface 17 would be slightly lower than the rack 18 so as to allow such rolling. In one embodiment, tubulars are advanced from the rack by using a tubular singulator, indexing means or other forcing means to urge tubulars to transfer laterally between the catwalk and the rack. In yet another embodiment, tubulars can be transferred between the rack 18 and the catwalk 10 by means of a crane or any other similar device. Various other tubular transfer mechanisms will be known to persons skilled in the art.

The catwalk 10 of the invention also preferably includes a skate 22 that is arranged to generally traverse the length of channel 19*b* the catwalk, from the rear end section 16 to the front end section 12. The skate 22 includes a collar 22*a* to grasp one end, preferably the male end, of a tubular after being loaded in channel 196 from channel 19*a* and to pull same in direction as needed towards the rear end section 16. The skate 22 also includes a bearing flange 22*b* surface for pushing the stand towards the front end section 12. As will be apparent to persons skilled in the art, the skate 22 can be advanced in either direction by a mechanical means, such as using a cable and pulley system 36 attached to a motor or a hydraulic means such as by using a cylinder and piston combination or any other motive means. Skate 22 runs along and underneath channel 19*b*. Skate 22 is provided with a collar 22*a* which may be elevated to attach to an end of one tubular by catching collar 22*a* against the raised shoulder of the collar an the male end of the tubular. Such collars or other clamps are commonly known in the art and any suitable clamp mechanism can be used for the skate.

In operation, a first tubular 20*a* is singulated and rolled in direction A into, or otherwise placed into, first channel 19*a* in the top surface 17 of catwalk 10. As shown, in, the preferred arrangement, the female end 24*a* of the tubular 20*a* is directed towards the front end 12 of catwalk 10. Tubular 20*a* rests on rollers 33*a* in channel 19*a*. Rollers 33*a* are driven selectively so that tubular 20*a* may be driven rearwardly in direction B towards rear end 16 to make way for the next tubular 20*b*, or driven in a direction opposite to direction B when urging the tubulars together end-to-end when making up a pipe stand. Thus, once a pipe stand is made up as better devised below, the pipe stand may be transferred laterally by kickers 38 into the delivery channel 196. Once the pipe stand is in channel 19*b*, skate 22 is then advanced under the pipe stand, for example under tubular 20*a* and grips the male end 26*a* thereof by elevating collar 22*a* up under the raised shoulder of male end 26*a*. The skate 22, in a "pull" mode, is then retracted in direction C to the rear end portion 16 of the catwalk apparatus 10. In this way, the stand is pulled towards the rear end portion 16. Once the skate 22 has reached its terminal point on the catwalk apparatus 10, the gripping mechanism is released, by in the illustrated embodiment, collar 22*a* being lowered.

Returning now to the description of the stand make-up process in channel 19*a*, once first tubular 20*a* has been loaded and translated out of the way rearwardly in direction B, a second tubular 20*b* is loaded into channel 19*a*. As with the first tubular 20*a*, the second tubular 20*b* is oriented with its female end 24*b* directed towards the front end section 12 The male end 26*b* of the second tubular 20*b* is positioned adjacent and in opposition to the female end 24*a* of the first tubular 20*a*. Tubulars 20*a* and 20*b* are aligned so as to be coaxial with each other. As will be understood, channel 19*a* serves to maintain the desired alignment of the tubulars 20*a* and 20*b*. Once the two tubulars 20*a* and 20*b* are so positioned, a plurality of threading devices provided in channel 19*a* are actuated. The threading devices in one embodiment include comprise elevating arms 33 and driven rollers 34. According to one embodiment, driven rollers 34 each include a pair of opposed rollers 34*a*. The rollers are arranged so as to form a pinch point 34*b* there-between, which is adapted to receive a portion of a tubular. Driven rollers 33*a* are mounted on the free ends of elevating arms 33 for translating tubulars longitudinally along channel 19*a*.

In operation, elevating arms 33 are rotated or pivoted to their raised position by any known means, such as hydraulically, mechanically etc. In such manner, the rollers 33*a* are raised up under their tubular, thereby raising the tubular from within pinch 34*b* between rollers 34. The arms 33*a* may be raised so that the tubular is raised above the top surface 17 of the catwalk.

The rollers 34 are driven either directly or indirectly by motors and the like so as to rotate the tubular in pinch point 34*b* therein about its longitudinal axis. In one embodiment, the rollers 34 are reversibly driven. Arms 33 and rollers 34 are designed with sufficient strength to support the tubular. The rollers 33*a* and 34*a* are made of a material that includes a sufficient coefficient of friction to cause rotation of the tubular when the tubular is resting on the rollers under its own weight.

Clamps 32 in channel 19*a* engage the first tubular 20*a*. Rollers 34*a* engage tubular 20*b* while the tubular 20*b* is urged in direction B towards tubular 20*a* by the corresponding driven rollers 33*a*. The two tubulars are rotated relative to each other. In particular, tubular 20*a* is clamped in clamps 32 and tubular 20*b* rotated about its longitudinal axis by rollers 34*a*. Once axial rotation of tubular 20*b* relative to tubular 20*a* has been completed so as to couple the two tubulars, rollers 33*a* translate the double pipe stand in direction B to make way for the third tubular 20*c*. The process is reversed to decouple tubulars in a stand.

The three tubular or triple pipe stand is formed by moving the two tubular stand away from the tubular loading station similar to the movement of tubular 20*a* to make way for tubular 20*b* when forming the two tubular stand. The rearward end of the two tubular stand may be translated so it is cantilevered off the end of the catwalk of the loading station. It may be supported by a telescoping or other removable support 16*a*. With the two tubular stand moved out of the way, the third tubular 20*c* is loaded into make up channel 19*a* from the pipe rack 18. The two tubular stands are clamped in clamps 32, and tubular 20*c* is translated to engage the female end of tubular 20*b* with pin end of tubular 20*c*. The threaded ends are then spun on.

Once the triple stand, comprising the joined tubulars 20*a*, 20*b* and 20*c*, is formed, the devices 32 and 33 are retracted and lowered respectively so as to allow the triple stand to rest in channel 19*a*. The triple pipe stand is then transferred in direction C to channel 19*b* by kickers 38.

Once the female end 24*c* of the third tubular 20*c* is positioned adjacent front end section 12, lifting arm 13 is rotated upwardly in direction D so as to elevate the lifting arm carriage 40 up against the underside of tubular 20*c* towards the male end 26*c* of tubular 20*c*. Continued rotation of lifting arm 13 in direction D elevates the pipe stand from channel 19*b*. As the front or upper end of the pipe stand, that is, the rig end, the rear end of the pipe stand is drawn along channel 19*b* and over the resting bass position of skater 22. Once the rear end of the pipe stand has passed over skate 22, is gradually elevated, skate 22 is advanced so as to engage bearing flange 22*b* against male end 26*a* of tubulars 20*a* thereby urging male end 26*a* of tubular 20*a* towards front end 12. Such elevation continues until the front end of the pipe stand, that is, the female end 24*c* of the third tubular 20*c*, reaches a position wherein a hoist 42 on the drilling rig 44 may be positioned to reach and grip the end 24*c* of the stand. The hoist mechanism then raises the stand to its vertical orientation above the drilling platform and the stand is then either connected to the existing drill string or is stored in the vertical position for future connection.

As will be known to persons skilled in the art, the terminal, surface exposed end of a drill string is normally the female end. As such, the lower end of the now vertical stand should comprise the male end in order to mate with the existing drill string. As will be understood from the above description, by positioning the tubulars on the rack with the female ends directed towards the front end section 12 of the catwalk apparatus 10, the formation of the stand takes place in such a manner that the formed stand, when oriented vertically, is in the desired position with the male end pointed downwards.

As will be understood by persons skilled in the art, the above described process can also be operated in reverse order to dismantle stands. That is, the hoist on the drilling rig can first extract a stand from a drill string and lower it on to the front end section 12 of the catwalk and over the top of the lifting arm. The skate 22 is then advanced and actuated to grip the lower end of the stand. The skate is then retracted towards the rear end section 16 of the catwalk supported by lifting arm 13, and in particular carriage 40 until the stand is rests in channel 19*b* in a generally horizontal orientation. The stand is then transferred to channel 19*a*. Each tubular segment of the stand is positioned on its respective rollers 34 or in its clamps 32. The clamps and rollers are then actuated to hold and rotate respectively the corresponding tubular so as to disconnect by unscrewing the tubulars in the stand. Once separated, one of the tubulars is then loaded onto the rack 18 by either rolling or by means of a device such as a crane etc. The second tubular is then translated by the rollers 33*a* into a position in channel 19*a* to enable the tubular to be moved to the rack as well. The last tubular in the stand is then similarly translated and moved to the rack.

Another feature of the present invention is the capability to automate the standbuilding operation. That is, as described above, very little manual manipulation of the tubulars or stands is needed. Thus, the entire process can be coordinated by an operator positioned away from the catwalk. In this way, the present invention provides a stand make-up and break-up system which comprises a safer alternative than processes known in the art. It will be understood that the apparatus discussed above will include suitable and commonly known electrical connections and/or processors etc. to enable such automation. For example, the system of the invention would include a control system to enable one or more operators to control various mechanisms on the catwalk 10, the rack 18 and/or the drill rig (i.e. the hoist). In such case, the rack may be provided with an automated feeder to feed single tubulars to and from the catwalk top surface 17. The skate 22, driven rollers, clamps, and lifting devices may in turn be controlled remotely by means of commonly known control circuitry. Similarly, the hoist described above may also be controlled remotely by the same operator so as to cause vertical lifting of the stand onto the rig. In one embodiment, the system may be controlled by a computer based control system, which can coordinate all of the above functions.

The front end 12 and rear end 16 sections of the catwalk apparatus 10 can be folded over the mid section 14. In this way, the apparatus 10 can be reduced in size to facilitate transportation between sites.

The above description has focused on "making up" a triple tubular stand. However, it will be appreciated that the present apparatus also provides a safe and efficient means of making up stands of several or more tubulars, given sufficient length of catwalk, and then lifting the built-up stand and translating the stand by one or more lifting arms towards the drilling rig for attachment to the hoist As described above, the combination of the lifting by the lifting arm of the rig end of the stand, the support of the stand by the left rig arm while the stand is being hoisted the pushing action by the skate 22, and causes the front end of the stand to be positioned over, the drilling platform for hoisting. Again, the hoist on the drill rig then raises the stand to a vertical orientation.

In the case of forming stands having several or more tubulars, a person skilled in the art will recognize that a functional limit in the length of stands lies as mentioned above, in the available length of support for the made-up stand on the catwalk, on the available height of the derrick provided on the drill rig, and the provision of a means of supporting the stand during hoisting, as one or more lifting arms, whether or not including sliding carriages, telescopic arms, etc, for supporting sequentially the front, mid and rear portions of the stand during hoisting of the stand from the catwalk.

In the above description, the skate 22 has been described as performing two functions, namely the "pulling" and "pushing" of tubulars. However, it will be understood that such dual role of the skate is a preferred embodiment. In other embodiments of the invention, each of these functions can be performed with two separate skate-like devices. Thus, one device may comprise a gripping mechanism to pull tubulars while a second device may comprise a bearing surface for pushing tubulars.

In a preferred embodiment, the ramp at the forward end of the catwalk is a V-door slide. During set-up, the catwalk the assembly is set in front of the substructure. The pipe support extension is folded out and the slide is folded up against the substructure at the V-door. Once set-up, and during operation when running in the hole, firstly a single tubular 20*a* of drill pipe is delivered from the pipe racks or pipe tub channel 19*a*. A stop plate is raised and the tubular of pipe is moved so the pin end of the tubular stops against the plate. The length of the tubular of pipe is automatically logged in a pipe tally data logger. The single pipe tubular is conveyed longitudinally away from the substructure to the opposite side of a hydraulic wrench.

Pipe dope (thread lubricant) is automatically applied to the box end threads of the tubular. The next single tubular 20*b* of drill pipe is then kicked or otherwise placed or fed into channel 19*a*. This tubular is again measured and the length of the tubular of pipe automatically logged in the pipe tally data logger. Pipe dope is automatically applied to the box end threads of second tubular 20*b*. The second single pipe tubular 20*b* is then conveyed longitudinally away from the substructure into the hydraulic wrench. The two tubulars of pipe 20*a* and 20*b* are made up to operator set torque level. The double stand is conveyed in channel 19*a* away from the substructure to the opposite side of the hydraulic wrench.

A third tubular 20*c* of pipe is kicked, placed, or fed into channel 19*a*. It is measured and the length is logged. Pipe dope is automatically applied to its box end threads. The third single pipe tubular 20*c* is conveyed along the building up channel 19*a* away from the substructure and into the hydraulic wrench. The third tubular of pipe is threaded into the double stand of pipe, to the operator set torque level.

The triple stand of the pipe is then kicked by kickers 38 or otherwise laterally translated from the building up channel 19*a* into a parallel adjacent delivering channel 19*b*. Lifting arm 13 then is rotated in direction D so as to engage a pipe gripper 40*a* in carriage 40 mounted on the pivoting lifting arm 13 against tubular 20*c*. The pipe gripper 40*a* may grip the triple stand of pipe at approximately the mid point of the third tubular 20*c*, that is, the tubular closest to the drilling rig end of the stand. As the lifting arm 13 pivots upwardly in direction D it cradles tubular 20*c* in carriage 40 and carries the triple stand of drill pipe toward the rig floor while supporting the length of the stand to control excessive bending of the stand.

The box end of the triple stand of pipe is presented to remote controlled elevators suspended from the top drive unit of the rig. The elevators are closed and as the blocks and top drive are raised, the triple stand is pulled upward.

When the elevators have been closed on the box end of the stand, the pipe gripper opens enough to allow the drill pipe to move on a roller assembly 806 mounted adjacent to the gripper 40*a*. As the triple stand is pulled upward in the drilling rig mast by the top drive, carriage 40 pivots relative to arm members 13*a* or lifting arm 13 on which the pipe gripper is mounted. Carriage 40 is slideably mounted between arm members 13*a* for selective translation along the arm members for example upward while pivoting so as to allow for the changing angular relationship between the pipe stand as it is hoisted and the lifting arm.

When coming out of the hole and laying down triple stands of drill pipe, the opposite sequence of events occurs. The pin end of the pipe that has been broken out of the stump, is passed to the main lifting arm 13 that has been fully pivoted with the carriage extended to the rig floor to receive the stand.

When running casing (range 3, approximately 45 feet in length), the assembly acts as a conventional skate; that is, a tubular of casing is kicked into the delivering channel 19*b* of the deck of the assembly unit. The tubular of casing is brought forward and guided up the V-door slide to the awaiting casing elevators. The casing is then pulled upward by the top drive secondary and guided to well center.

As stated above, lifting arm 13 allows the lifting of long pipe stands between a horizontal position and a substantial vertical position. The reference to long pipe stands is intended to include triple stands as described above. With such long pipe stands, bending of the pipe stand becomes a problem if an operator attempts to hoist the pipe stand by merely lifting only one end of the pipe stand. The pipe stands, because they are long, heavy and flexible, will if lifted only by one end, risk bending perhaps to the point of buckling. Thus, as found in the prior art techniques for lifting pipe stands, when the hoist is attached to the rig end of the pipe stand and the pipe stand lifted, the pipe stand may then be excessively bent during lifting due to the length of the pipe stand. If the opposite end of pipe stand, that being the end remaining on the catwalk, is pushed by a pushing device such as a skate such as taught in the prior art, again between the pushing of one end and the pulling vertically upwards of the other end, a long pipe stand such as a triple stand may be excessively bent causing buckling.

Figures 14A, 14B, 14C, 14D, 14E, 14F, 14G, 14H, 14I, 14J, 14K:
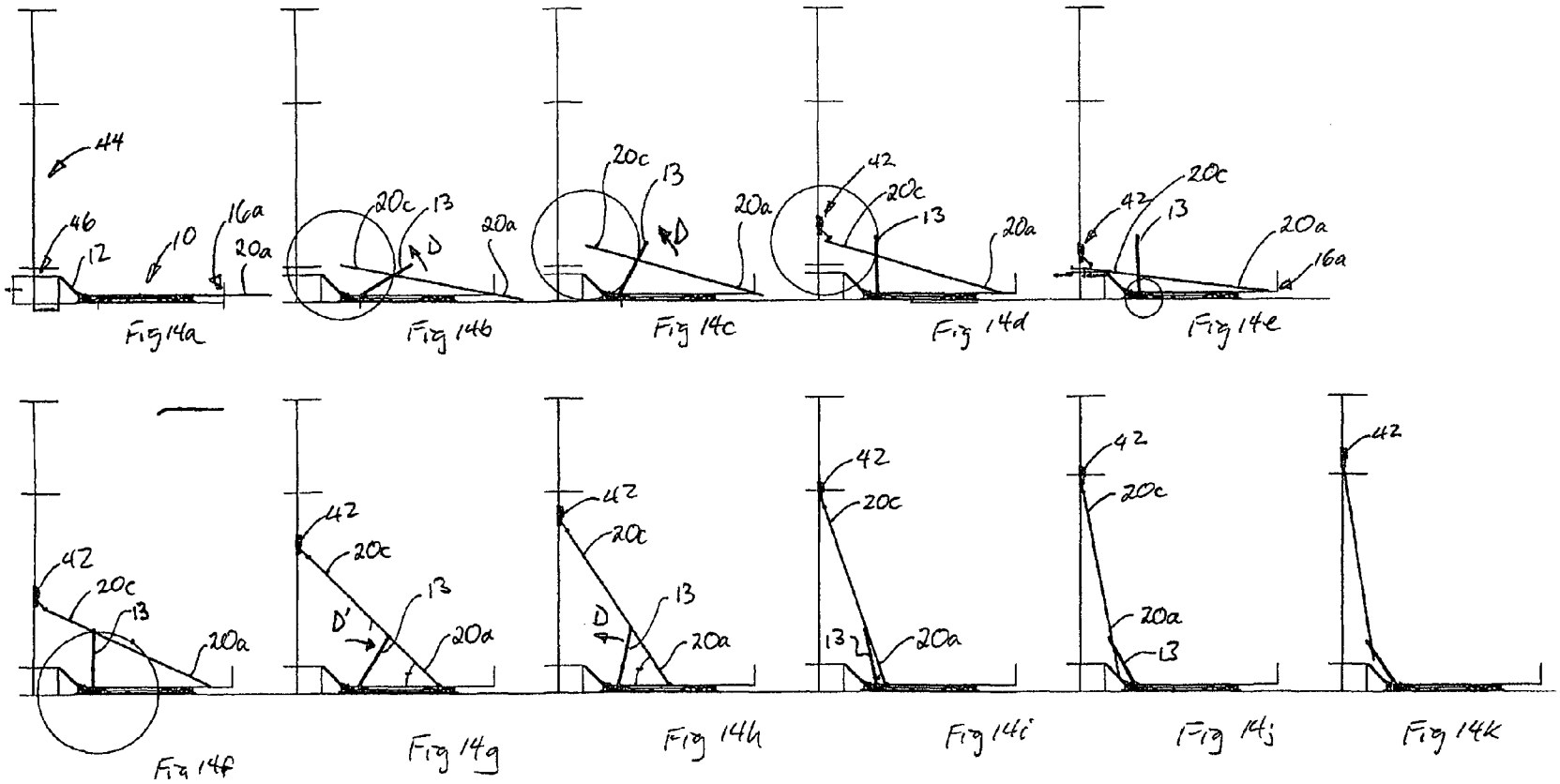
FIG. 14*a* is, in diagrammatic side elevation view, the catwalk according to one embodiment to the present invention positioned adjacent an oil drilling rig so as to position the front end ramp of the catwalk adjacent the drilling platform, underneath the derrick.
FIG. 14*b* is the view of FIG. 14*a* illustrating the lifting arm commencing to lift the triple pipe stand from the delivery channel of the catwalk
FIG. 14*c* is the view of FIG. 14*b* illustrating the delivery arm further rotating towards the vertical so as to continue to lift the front portion of the triple pipe stand from the delivery channel and to translate the triple pipe stand towards the derrick.
FIG. 14*d* is the view of FIG. 14*c* illustrating the lifting arm at the vertical having translated the triple pipes stand upwardly and forwardly so as to present the forward of upper end of the triple pipe stand to the derrick hoist.
FIG. 14*e* is the view of FIG. 14*d* illustrating the lifting arm in the position of FIG. 14*d* with the carriage of the lifting arm lowered so as to the forward end of the triple pipe stand to the deck of the rig platform.
FIG. 14*f* is the view of FIG. 14*e* illustrating the triple pipe stand being lifting by the derrick hoist with the hoist mounted to the forward or upper end of the triple pipe stand and with the lifting arm still at the vertical and the carriage of the lifting arm having elevated so as to support the forward and mid portion of the triple pipe stand as the triple pipe stand is translated longitudinally along the catwalk as it is elevated up the derrick
FIG. 14*g* is the view of figure of 14*f* illustrating the continued hoisting of the triple pipe stand up the derrick and illustrating the lifting arm having rotated from the vertical back towards the catwalk so as to continue to support the mid portion of the triple pipe stand as it is hoisted.
FIG. 14*h* is the view of FIG. 14*g* illustrating the continued hoisting of the triple pipe stand up the derrick and illustrating the lifting arm continuing to support the mid portion of the triple pipe stand with its carriage elevated to its maximum elevation along the lifting arm and the lifting arm returning towards the vertical position.
FIG. 14*i* is the view of FIG. 14*h* illustrating the continued hoisting of the triple pipe stand up the derrick and illustrating the lifting arm having rotated past vertical so as to continue to support the mid and rear portions of the triple pipe stand as the triple pipe stand is hoisted.
FIG. 14*j* is the view of FIG. 14*i* illustrating the continued hoisting of the triple pipe stand up the derrick and illustrating the lifting arm having continued to rotate from the vertical towards its delivery position adjacent the drilling rig.
FIG. 14*k* is the view of FIG. 14*j* illustrating the continued hoisting to the triple pipe stand up the derrick and the illustrating the lifting arm continuing to rotate towards its delivery position.
Figure 15:
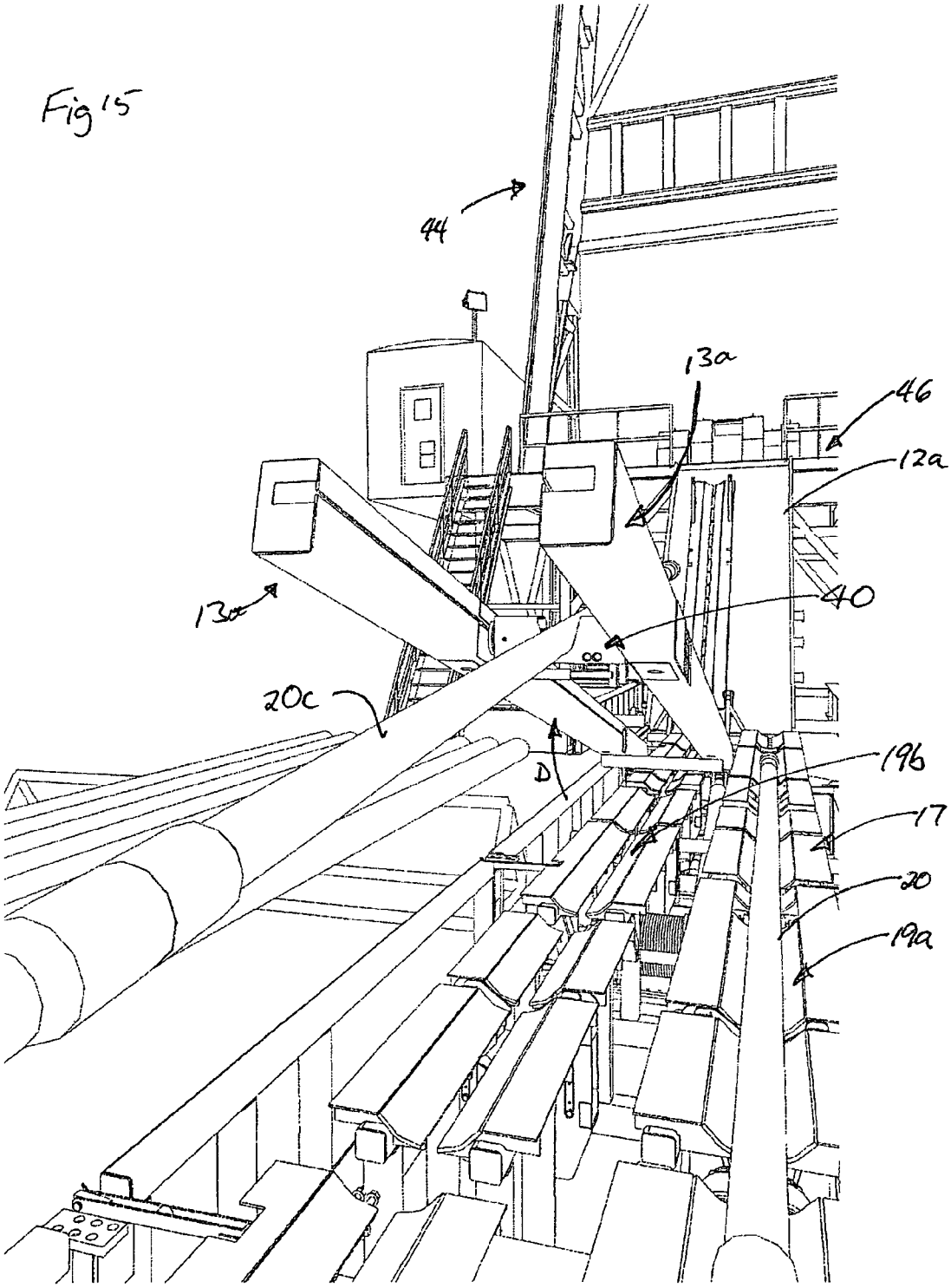
FIG. 15 is an enlarged perspective view of a portion of FIG. 8 illustrating the support of the third tubular in the triple pipe stand in the pivoting carriage of the lifting arm in its position initially lifting the triple pipe stand from the delivery channel.
Figure 15A:
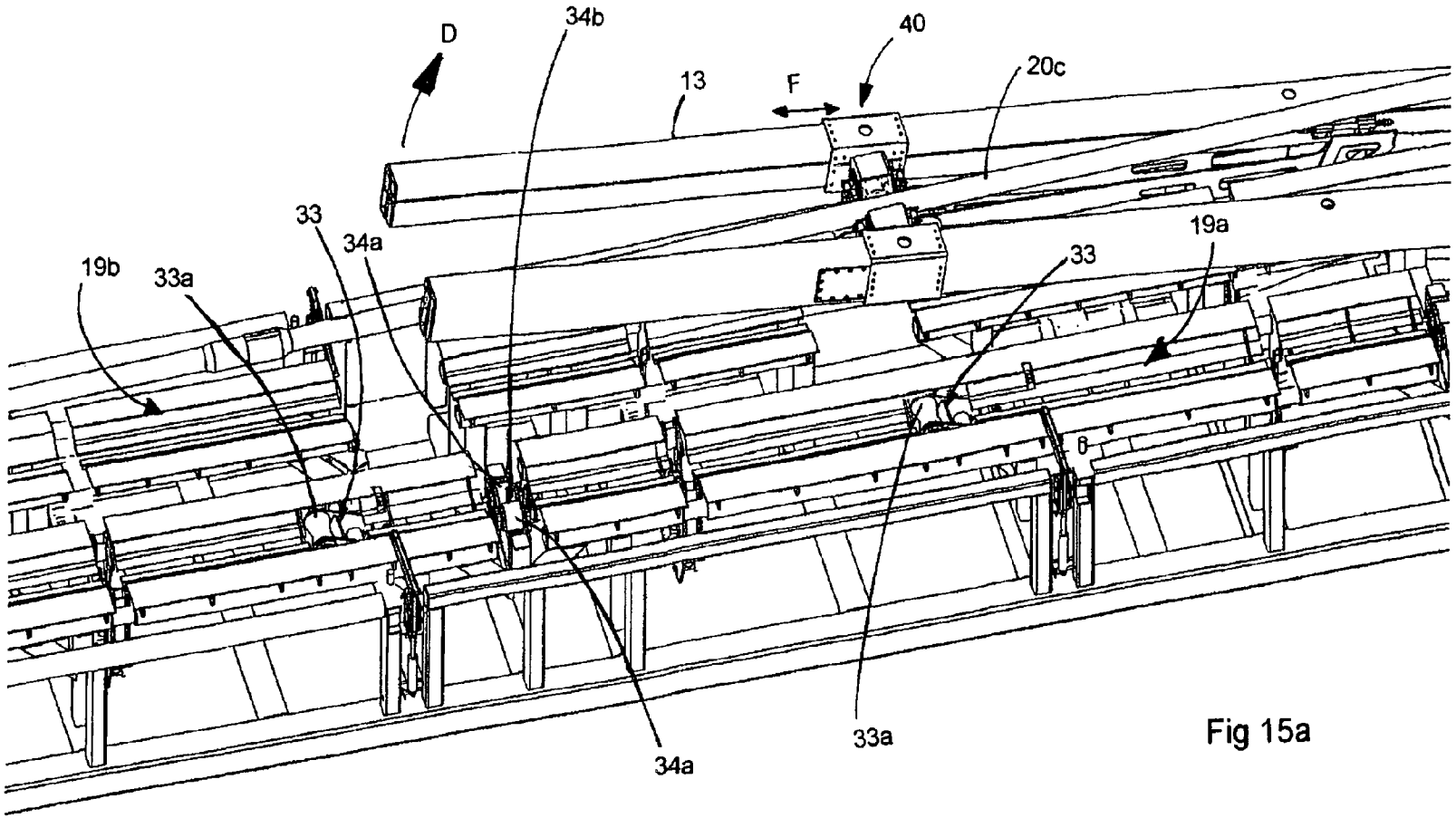
FIG. 15*a* is an enlarged perspective view of a portion of FIG. 8*a* when viewed from the laterally opposite side of the view of FIG. 8*a*, showing the support of the third tubular in the triple pipe stand in the pivoting carriage of the lifting arm in its position initially lifting the triple pipe stand from the delivery channel.
Figure 16:
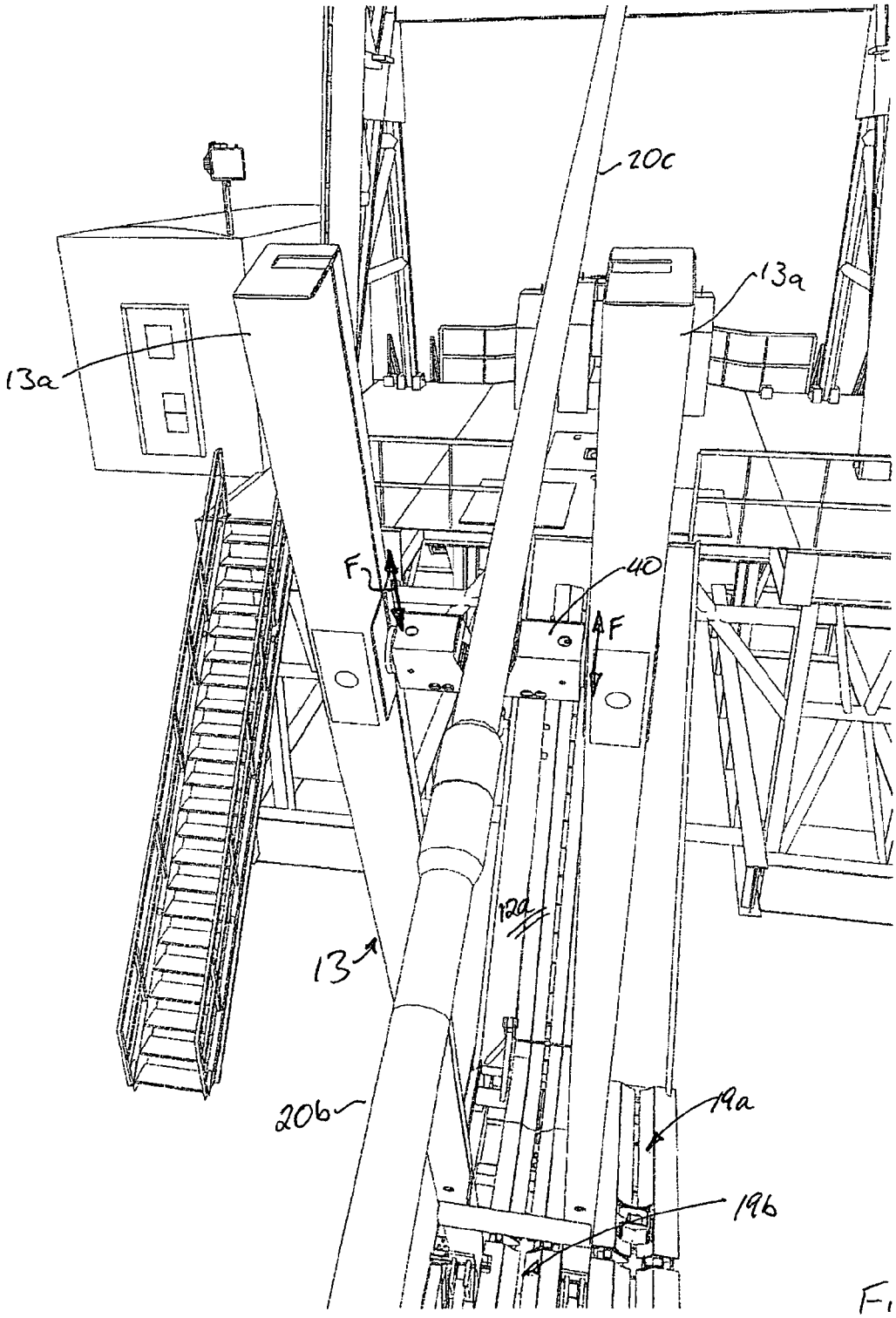
FIG. 16 is an enlarged perspective view of a portion of FIG. 10 illustrating the continued support of the forward or upper end of the triple pipe stand as it is lifted and translated so as to present the forward or upper end of the triple pipe stand for hoisting up the derrick.
Figure 16A:
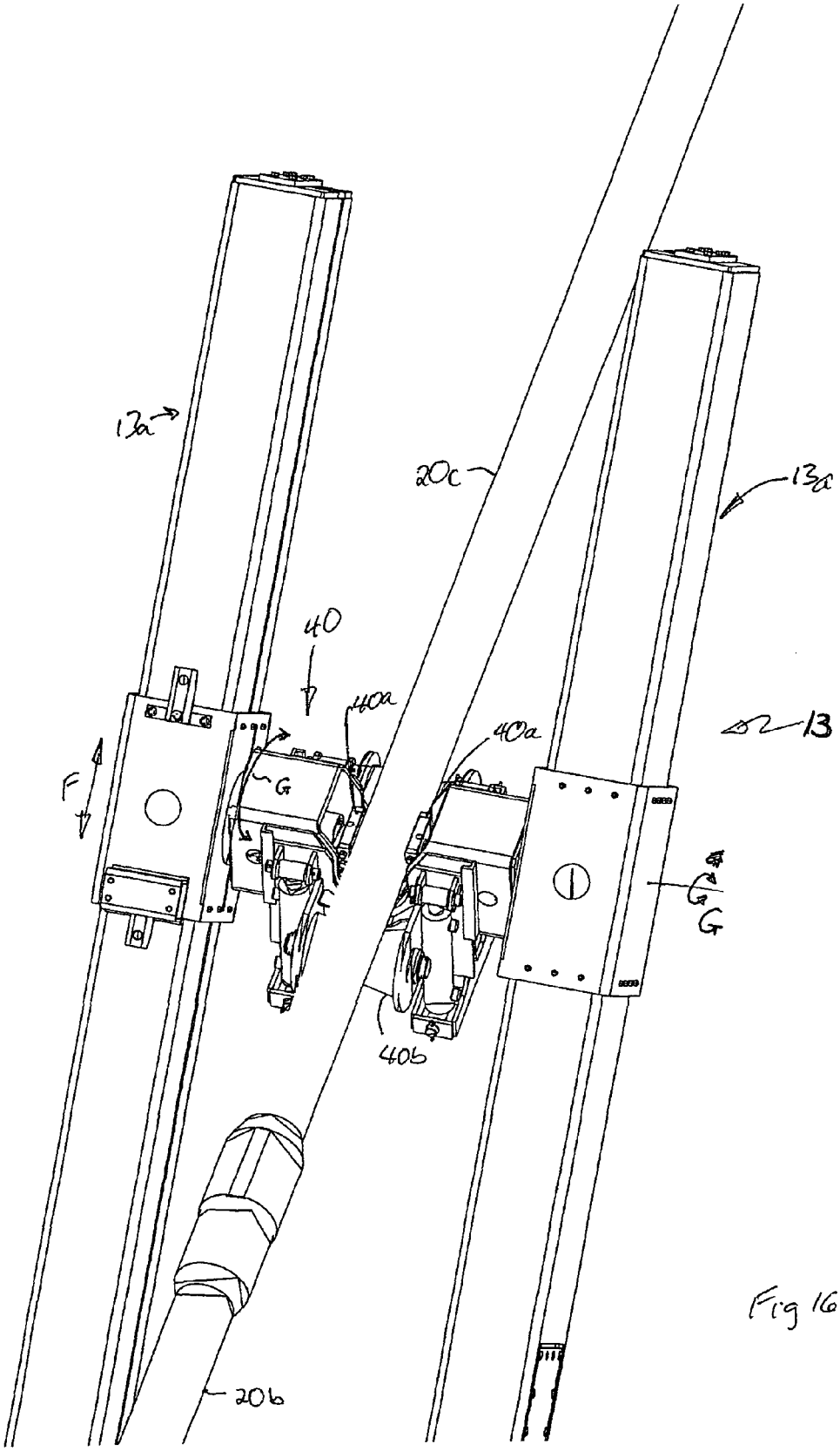
FIG. 16*a* is an enlarged perspective view of a portion of FIG. 16 showing in greater detail the pivoting carriage on the lifting arms.
Figure 17:
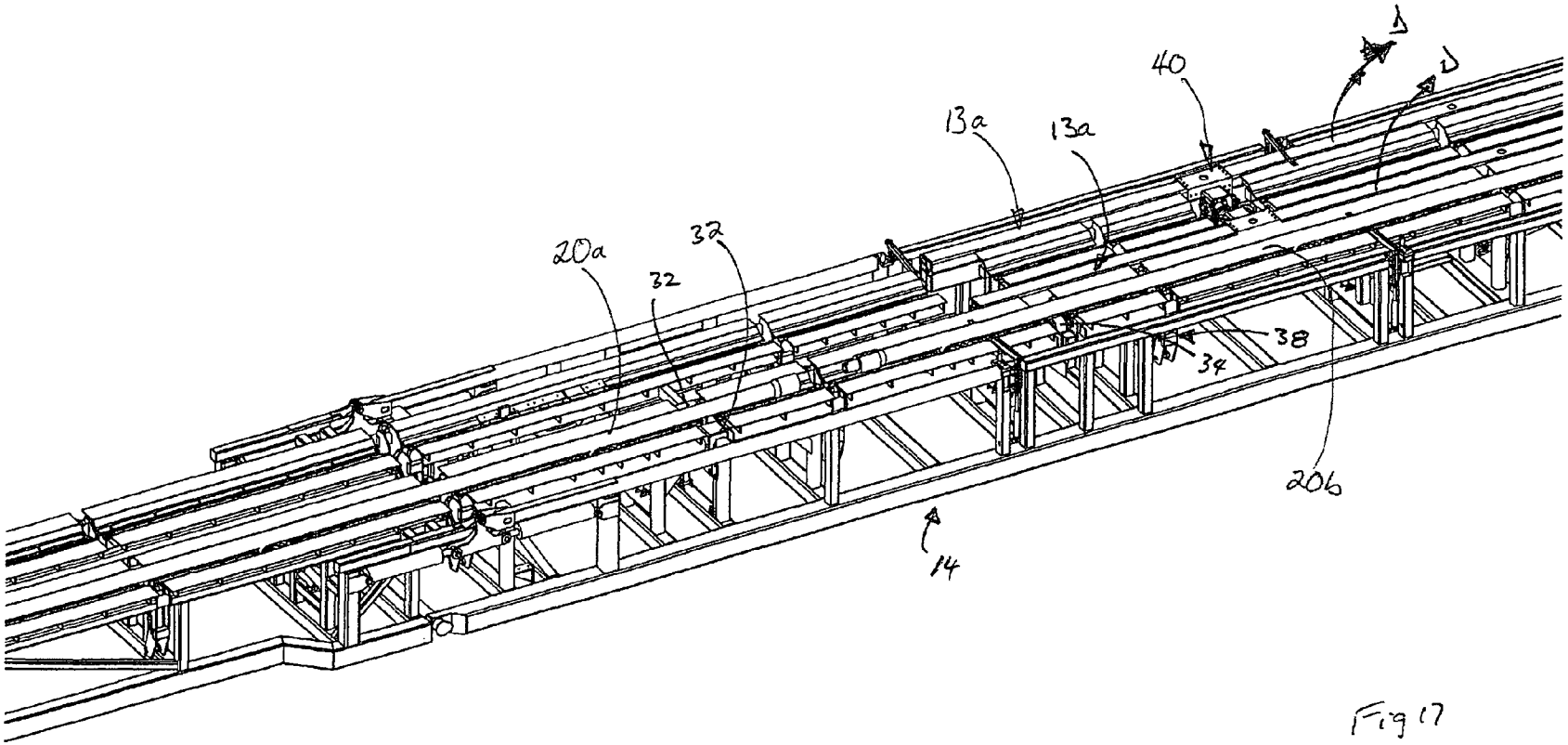
FIG. 17 is an enlarged perspective view of a portion of FIG. 4 illustrating in greater detail the making up of the first double pipe stand.
Figure 18:
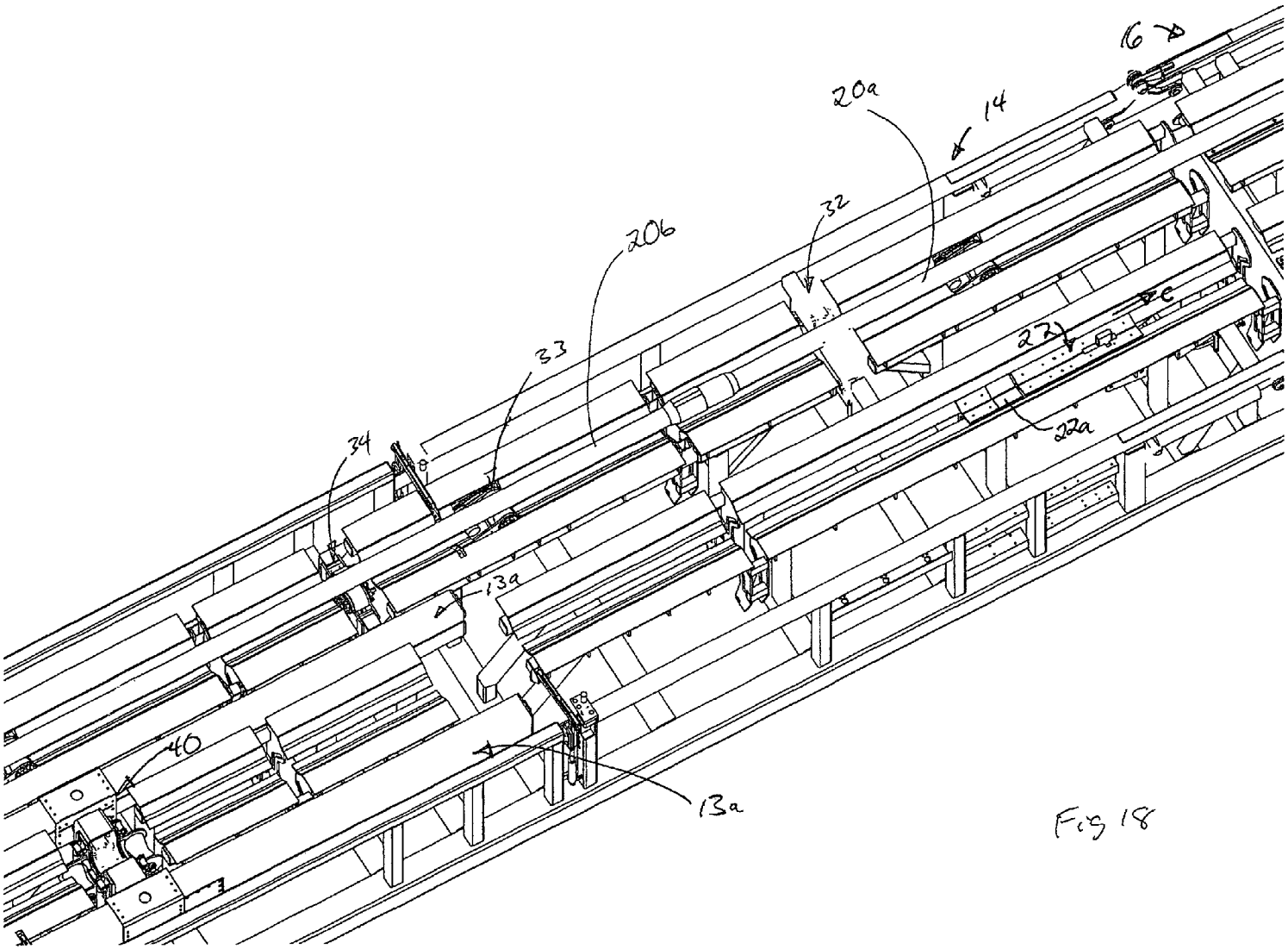
FIG. 18 is an enlarged perspective view of a portion of FIG. 5 illustrating the joint being made up between the first and second tubulars.
Figure 19:
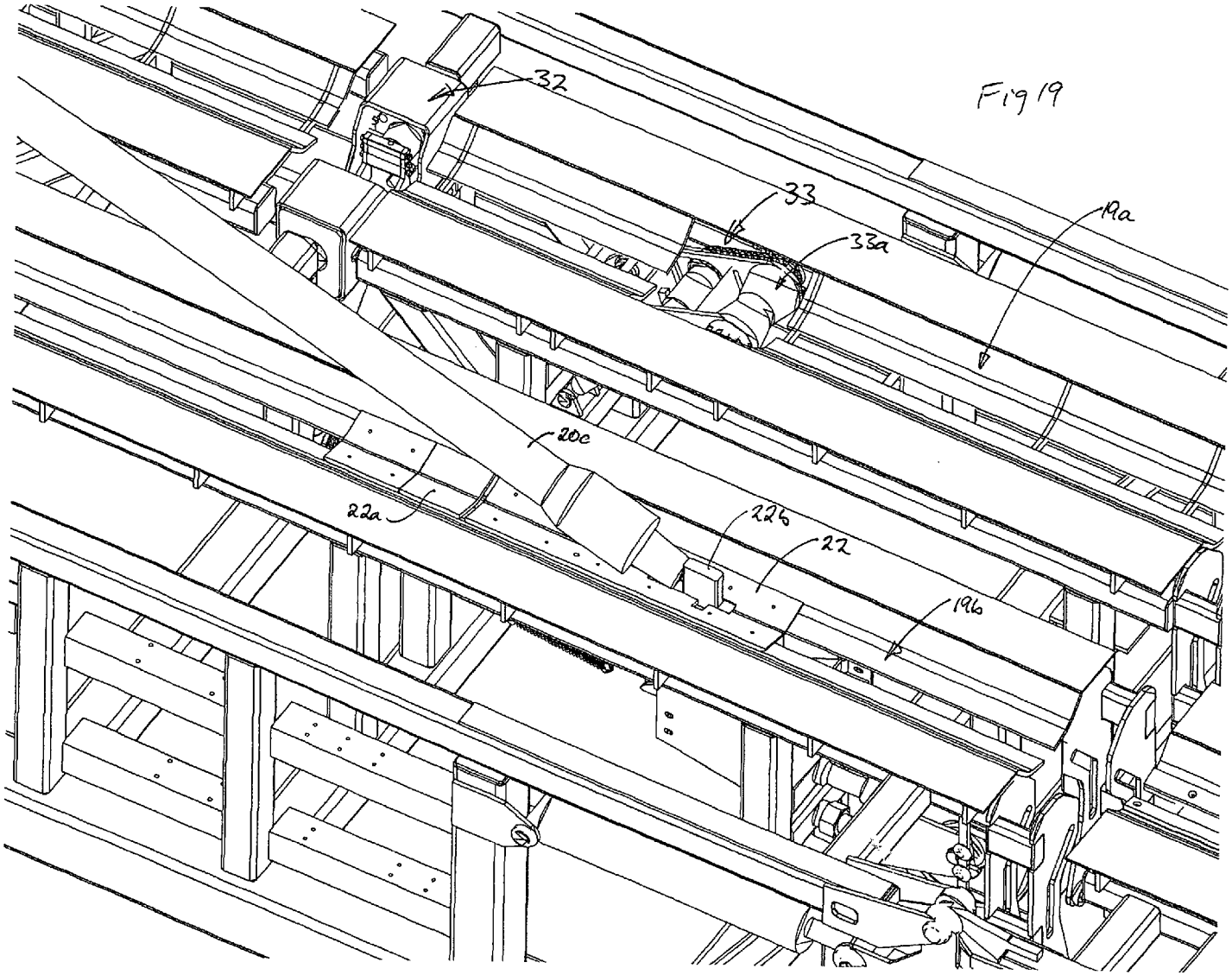
FIG. 19 is an enlarged top perspective view of a portion of FIG. 10*a* showing the pushing engagement of the skate behind the rear or lower end of the triple pipe stand as it is being hoisted from the delivery channel.
Figure 20:
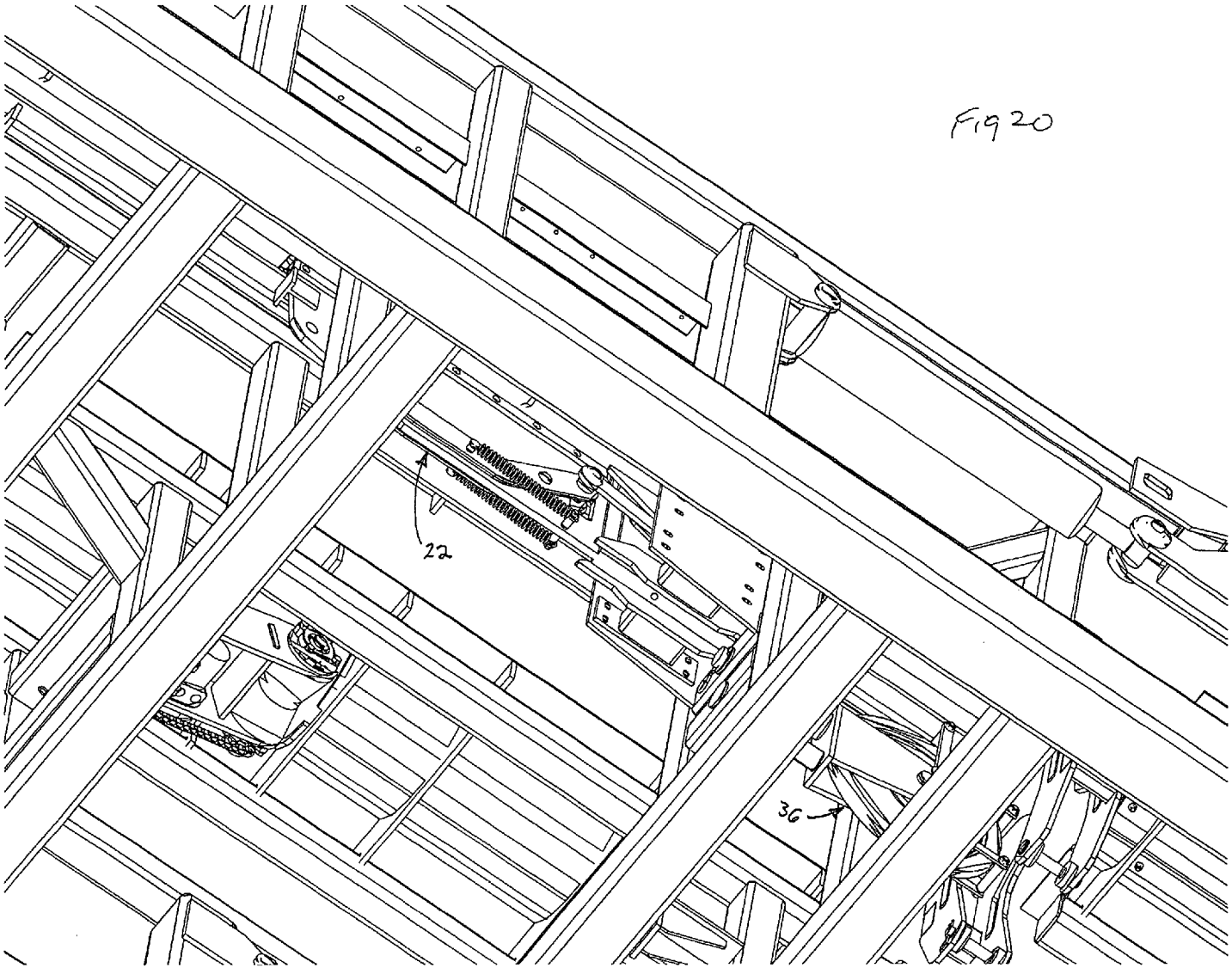
FIG. 20 is a bottom perspective view of the view of FIG. 19.
Figure 20A:
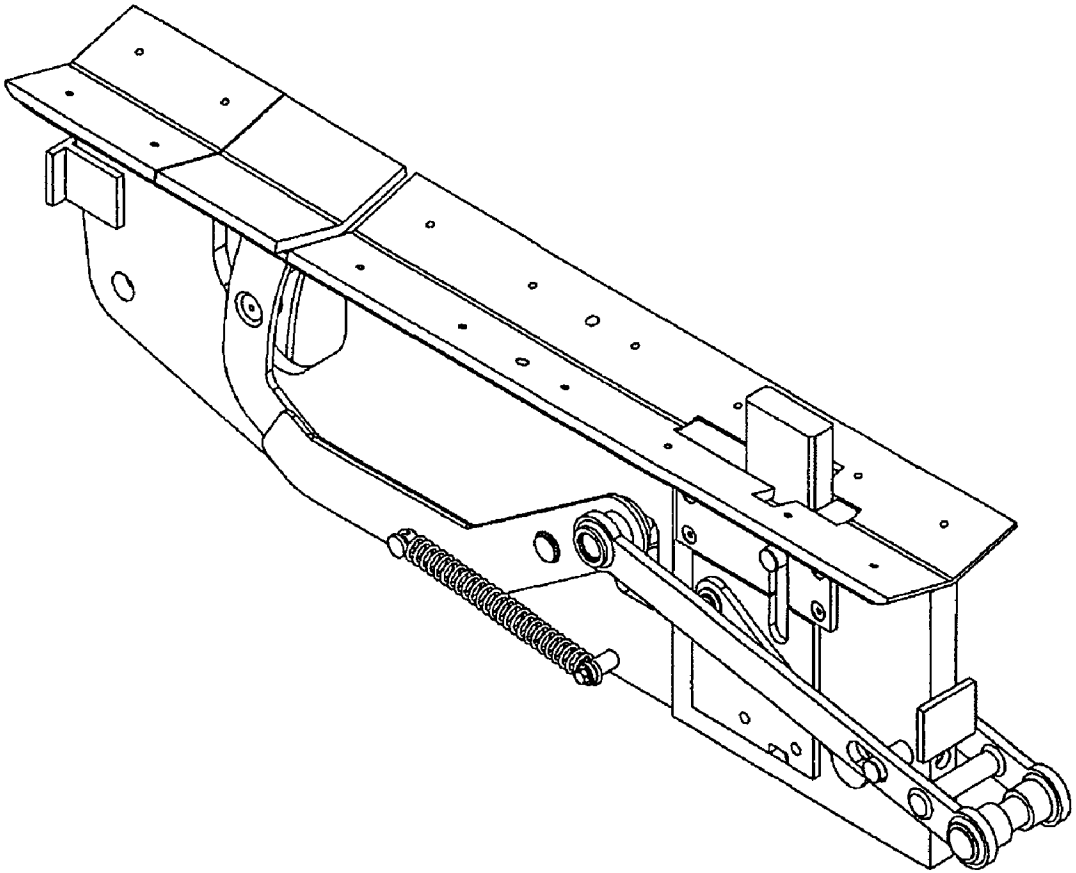
FIG. 20*a* is in perspective view, the skate of FIG. 19
Figure 20B:
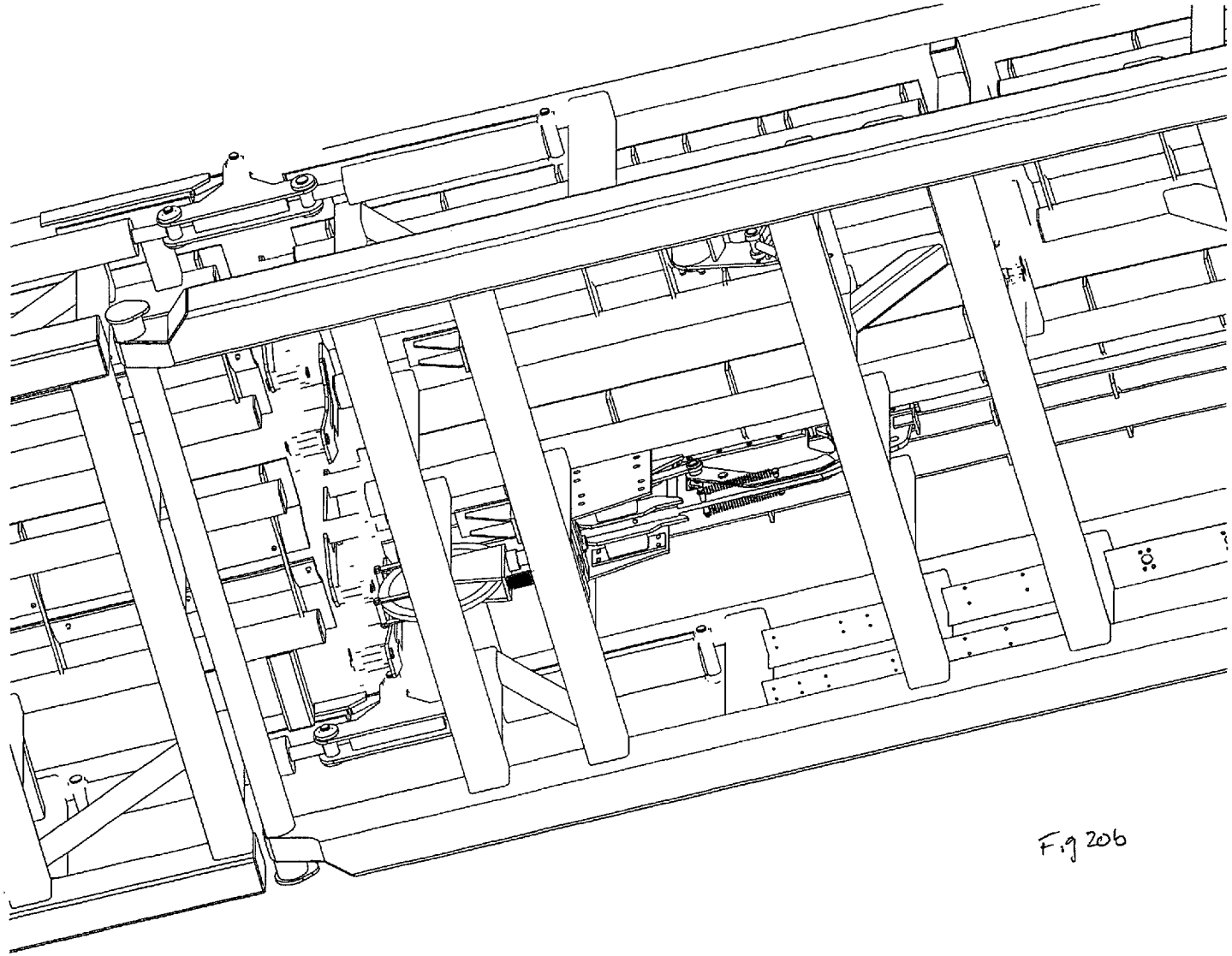
FIG. 20*b* is, in bottom perspective view, the skate of FIG. 19 in its rear-most position along the delivery channel.
Figure 20C:
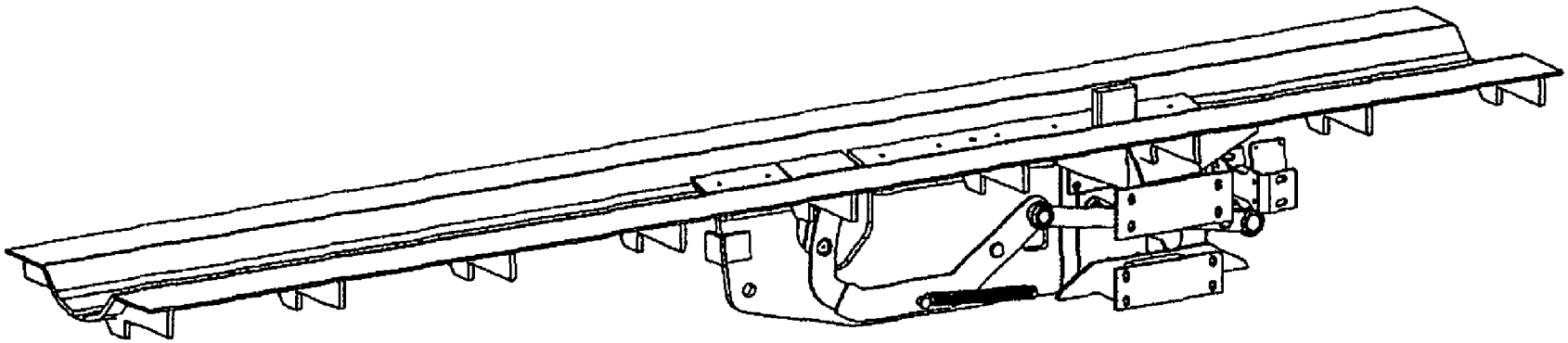
FIG. 20*c* is a partially cutaway top perspective view of the skate and skate dock of FIG. 20*b*.
Figure 20D:
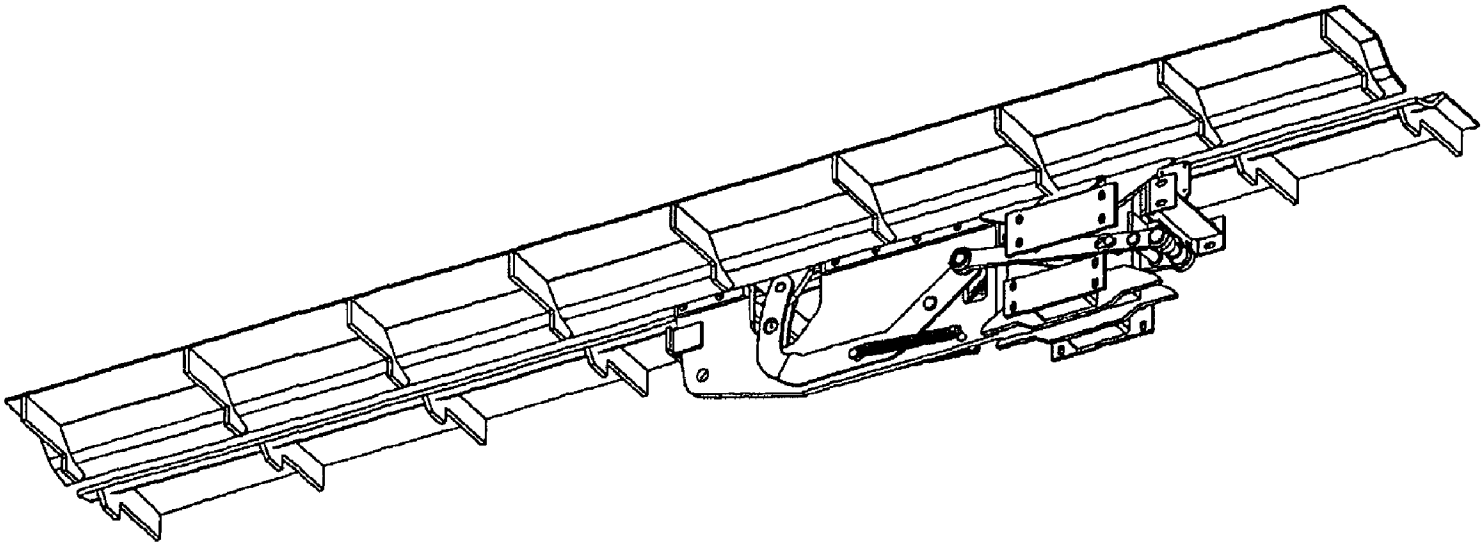
FIG. 20*d* is a bottom perspective of the skate and skate dock of FIG. 20*c*.
Figure 21A:
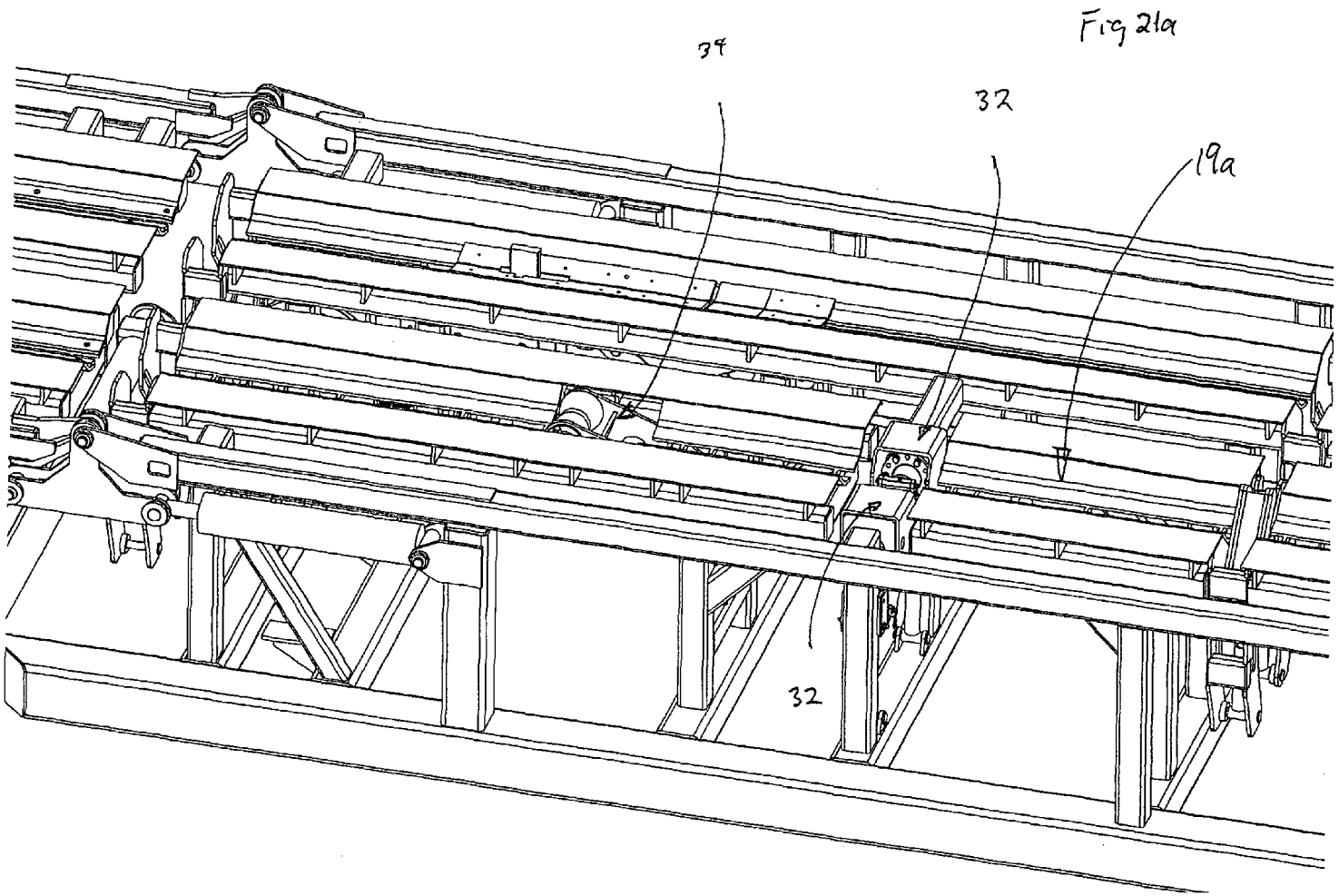
FIG. 21*a* is a side perspective views of a driven roller and clamp mounted under the make-up channel.
Figure 21B:
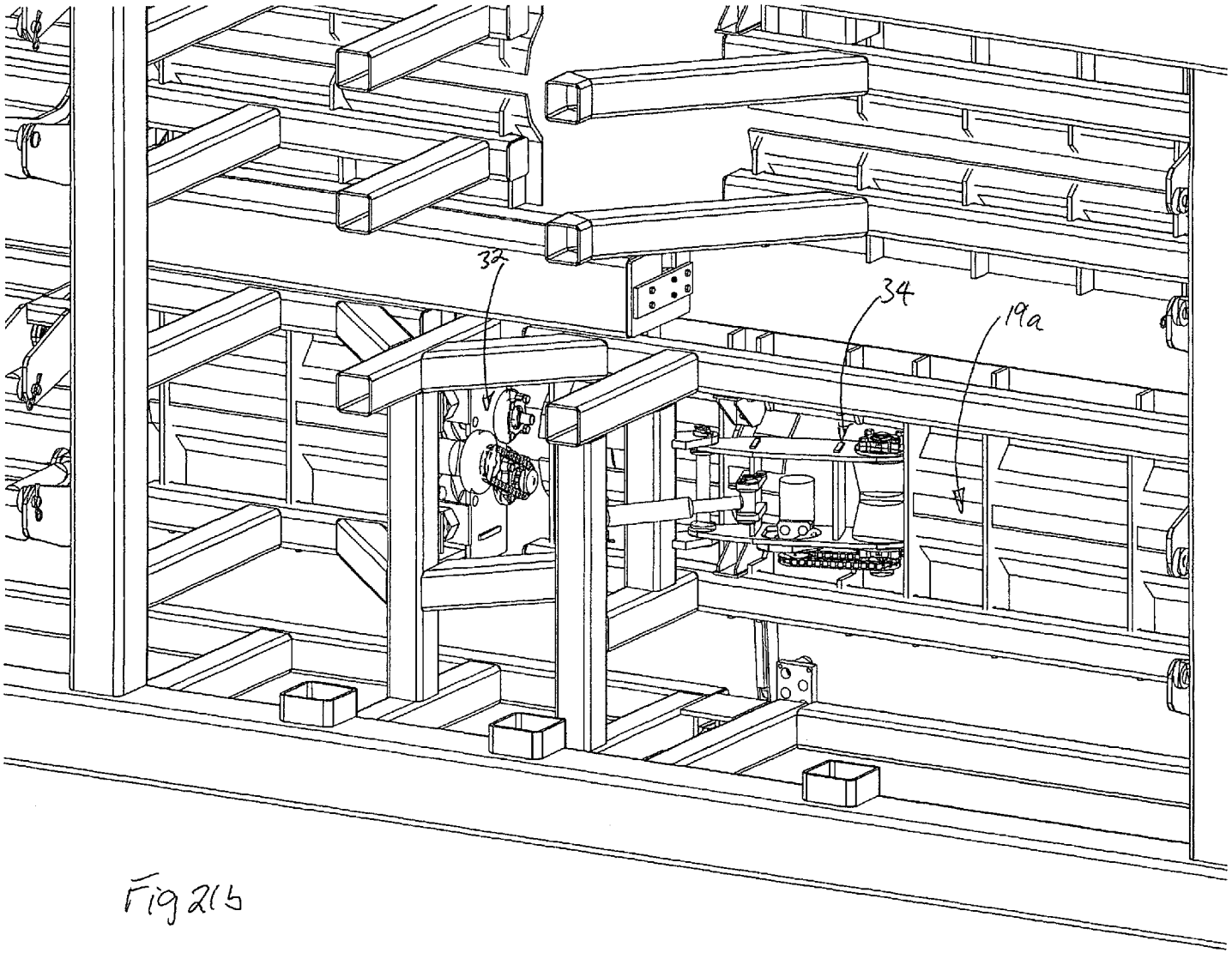
FIG. 21*b* is a bottom perspective view of FIG. 21*a*.

Thus the use of lifting arm 13 according to the present invention assists in supporting firstly the front portion, then the mid portion, and lastly the rear position of the pipe stand as it is lifted by lifting arm 13 and in part pushed by skate 22 toward the hoist on the drilling rig and subsequently lifted by the hoist to the vertical. As seen in the sequence of views comprising FIGS. 14*a*-14*k*, it is advantageous that the lifting arm not only capture the mid portion of the pipe stand and assist in conveying the pipe stand to the hoist, which, by itself is a significant improvement over the prior art, but also in an preferred embodiment support sequentially the front, mid and rear portion of the stand during lifting and hoisting. Advantageously lifting arm 13 includes a movable carriage 40 which may be selectively positioned by sliding in tracks between the posts 13*a*, along the length of the lifting arm 13. Thus, in the initial lifting of the rig end of the pipe stand, carriage 40 will not be positioned at the furthest free end of the lifting arm 13 but will be positioned somewhere lower along its length, for example approximately two thirds up along the length of the lifting arm 13. This is however not intended to be limiting as the carriage 40 may start at any position along the lifting arm 13 and, as it engages the pipe stand then slide upwardly along the length of the lifting arm as the lifting arm is rotated upwardly.

In a preferred embodiment, carriage 40 includes a selectively actuable stand gripper 40*a*, such as the illustrated clamps which clamp onto the desired position along the pipe stand, for example approximately two thirds along the distance of the rig end of 20*c*, so that as lifting arm 13 is rotated upwardly in direction D, the full length of the pipe stand will be not only lifted but also translated towards the derrick. This then removes the need to use skate 22 to push the opposite end of the pipe stand, herein the male end of tubular 20*a*, towards the derrick thus allowing that end of the pipe stand to be left to freely cantilever off the furthest end of the catwalk merely supported for example by a telescopic support. With the first tubular in the pipe stand thus gripped by the clamps in the carriage, and with the carriage pivotally mounted within and between the twin parallel posts or arm members 13*a* of lifting arm 13, carriage 40 is allowed to rotate about a transverse horizontal access axis E, relative to lifting arm 13. As lifting arm 13 is being rotated upwardly in direction D, carriage 40 may then be simultaneously also elevated or lowered along the length of the lifting arm in direction F.

The carriage 40, because it is selectively positionable along the length of lifting arm 13, will then follow an arcuate path having a varying radius of curvature depending on the distance between the carriage and, in any particular instant during the lifting of the pipe stand the base of the lifting arm where it is pivotally mounted to the frame of the catwalk. So as again may be seen in the sequence of views in FIGS. 14*a*-14*v*, initially the first tubular once gripped by the clamps in the carriage, is elevated while the carriage is in its lowered position along the lifting arm. As the lifting arm proceeds to the vertical, the carriage may stay stationary in its position relative to the lifting arm as the rig end of the first tubular, that is, the end of the tubular closest to the hoist, is translated in an arc from its position resting in channel 19*b*, and then upwardly and over the edge of the drilling rig's platform so as to present the rig end of the pipe stand for mounting to the hoist. Once the hoist then has been mounted onto the rig end of the pipe stand, the hoist then commences its vertical travel upwardly. The hoist takes the rig end of pipe stand with it. At that point then, in order to support the mid portion of the pipe stand, the carriage elevates upwardly along the length of lifting arm and simultaneously the carriage clamps are released so that the pipe stand is free to translate through the carriage that is, relative to the carriage and its clamps on the rollers 40*b* provided in the tubular receiving collar of the carriage 40.

With the carriage at the uppermost end of the lifting arm, in order for the carriage to remain supporting the pipe stand, the lifting arm then has to be rotated to various positions to remain in contact with now the opposite end of the mid portion of the pipe stand. Thus as seen again in the sequence of views, the lifting arm having initially rotated from its stored position flush with or under channel 19*b* and upwardly through the vertical, and in some embodiments not shown, further extending past the vertical towards the drilling platform so as to present the end of the pipe stand to the hoist, the lifting arm then returns to the vertical if it has left from the vertical and then starts rotating back towards its position flush with channel 19*b* on the catwalk, this again allows the carriage to remain in contact with the pipe stand as the pipe stand is being elevated as seen for example in FIG. 14*g*. The position of lifting arm 13 at this point is approximately inclined forty five degrees from the horizontal. Then as seen in the following figures in the sequence, as the pipe stand is further hoisted towards the vertical, lifting arm 13 returns from its inclined position at the forty five degree angle back towards the vertical, and then past the vertical position, so as to be inclined towards the drilling rig platform during which time the pipe stand is being constantly pulled through the collar in the carriage. The carriage pivots to accommodate the various angles that the pipe stand forms relative to lifting arm 13. In the end of the sequence, the bottom end of the pipe stand has been elevated just above the elevation of the drilling rig platform and is held along the edge of the drilling rig platform by the end of the pipe stand being just retained by the carriage. Once the pipe stand is hoisted any further, the lowest end of the pipe stand will swing free from the carriage and may be guided to the drill stem. The pipe stand at that time may be threaded then down onto the exposed drilling stem for drilling to recommence.

When the drill string is being broken down, the reverse procedure is employed as triple stands are removed from the drill string as the drill string is hoisted out of the ground. Thus the illustrated sequence of FIG. 14*a*-14*k* is then followed in reverse to take the triple stands from the vertical and return them to the horizontal for break down in channel 19*a* and from there removal of the individual tubulars for storage As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus for forming a pipe stand from tubulars comprising:

a substantially horizontal, elongate catwalk having a frame, said catwalk having a top surface adapted to receive at least two tubulars aligned coaxially manner along a linear path on said top surface, said frame having a front end, a rear end, and a mid section;

a selectively actuable lifting arm for selectively elevating a rig end of a pipe stand from said surface;

a selectively actuable means for urging the tubulars along said surface between said front and rear ends so as to urge ends of successive tubulars together into an end-to-end mating position;

a rotating means for relative rotation of tubulars in said end-to-end position about corresponding longitudinal axes of the tubulars so as to threadably engage end-to-end positioned tubulars together to form at least one section of a completed pipe stand;

means for translating the completed pipe stand towards said front end and over said lifting arm;

means for selectively actuating said lifting arm to lift and translate the completed pipe stand so as to position the rig end of the pipe stand into a hoisting position adjacent a drilling rig derrick, wherein said lifting arm includes an arm member and a selectively actuable clamp mounted on said arm member so as to selectively hold in place the rig end of the pipe stand, wherein, during an initial lifting of the pipe stand, the rig end of the pipe stand is held in place relative to said arm member by said clamp so as to translate the pipe stand by said actuation of said lifting arm.

2. The apparatus of claim 1 wherein said clamp is mounted on a carriage and wherein said carriage is mounted on said arm member of said lifting arm and adapted so as to be selectively positionable along said arm member.

3. The apparatus of claim 2 wherein said arm member has a base end and an opposite distal end, said base end pivotally mounted to said frame, a selectively actuable actuator selectively rotating said arm member about said base end between a lowered position, a vertical position, and a delivery/pickup position opposite said lowered position in an arc lying in a substantially vertical plane parallel with said linear path.

4. The apparatus of claim 3 wherein said linear path of said top surface of catwalk includes at least one channel adapted to receive the tubulars, and wherein said arm member of said lifting arm is coextensive with at least a portion of one channel of said at least one channel when said arm member is in said lowered position.

5. The apparatus of claim 4 wherein said arm member is flush with said one channel of said at least one channel when in said lowered position.

6. The apparatus of claim 5 wherein said at least one channel includes a substantially parallel pair of channels, and wherein said pair of channels include a make up channel and a, delivery channel and wherein said arm member is mounted so as to cooperate with said delivery channel.

7. The apparatus of claim 6 further comprising selectively actuable lateral translators, said lateral translators selectively laterally translating the pipe stand, once assembled, from said make-up channel to said delivery channel.

8. The apparatus of claim 7 wherein said carriage is pivotally mounted on said arm member.

9. A method of forming a pipe stand from a plurality of tubulars comprising:

(a) providing a supply of tubulars;

(b) providing an elongate stand forming frame having a top surface front end, rear end and mid section, wherein said top surface is adapted to receive at least two tubulars aligned coaxially along a linear path on said top surface;

(c) providing an actuable lifting arm adjacent said front end for selective raising and translation of a pipe stand of tubulars along said linear path and over said front end and providing selectively actuable means for urging tubulars along said linear path;

(d) loading a first tubular onto said linear path between said front and rear ends;

(e) urging the first tubular towards said rear end;

(f) loading at least a second tubular onto said linear path between the first tubular and said front end, wherein the second tubular and successive tubulars are positioned in succession along said path;

(g) rotating the first and second tubulars relative to one another while urging them together so as to threadably couple the first and second tubulars, and then rotating any subsequent tubulars relative to the first and second tubulars about their longitudinal axes while urging together the subsequent tubulars with the first and second tubulars so as to form the pipe stand;

(h) urging the pipe stand towards the front end and over the lifting arm;

(i) elevating the lifting arm;

(j) translating the pipe stand while elevating the pipe stand on the lifting arm to position a rig end of the pipe stand adjacent a derrick for hoisting of the pipe stand up the derrick, wherein said lifting arm includes an arm member and a selectively actuable clamp mounted on said arm member, the method further comprising the steps of holding the rig end of the pipe stand in place on said lifting arm and initially lifting the rig end of the pipe stand while held in place by said clamp, and actuating said lifting arm so as to translate the pipe stand.

10. The method of claim 9 wherein said clamp is mounted on a carriage and wherein said carriage is mounted on said arm member of said lifting arm and adapted so as to be selectively positionable along said arm member, the method further comprising the step of selectively positioning said carriage along said arm member so as to optimize maintaining for as long as possible support of the weight of the pipe stand by said carriage as the pipe stand is hoisted up the derrick.

11. The method of claim 10 wherein said arm member has a base end and an opposite distal end and wherein, said base end is pivotally mounted to said frame, and wherein said lifting arm includes a selectively actuable actuator the method further comprising the step of selectively rotating said arm member about said base end between a lowered position, a vertical position, and a delivery/pickup position opposite said lowered position in an arc lying in a substantially vertical plane parallel with said linear path so as to said optimize said support of the weight of the pipe stand.

12. The method of claim 11 wherein said linear path includes at least one channel adapted to receive the tubulars, and wherein said arm member of said lifting arm is coextensive with at least a portion of one channel of said at least one channel when said arm member is in said lowered position, the method further comprising the step of rotating said arm member to said lowered position prior to loading of a rig end tubular.

13. The method of claim 12 further comprising the step of lowering said arm member so as to be flush with said one channel of said at least one channel when said arm member is in said lowered position.

14. The method of claim 13 wherein said at least one channel includes a substantially parallel pair of channels, and wherein said pair of channels include a make up channel and a delivery channel and wherein said arm member is mounted so as to cooperate with said delivery channel, the method further comprising the steps of making up a first pipe stand in said make up channel independently of delivery of a second pipe stand by said lifting of the second pipe stand from said delivery channel by said lifting arm.

15. The method of claim 14 further comprising providing selectively actuable lateral translators, for selectively laterally translating a pipe stand, once assembled in said make up channel, from said make-up channel to said delivery channel when said delivery channel is empty.

16. The method of claim 15 further comprising the step of providing said carriage pivotally mounted on said arm member.

17. The method of claim 11 wherein said maintaining of support of the weight of the pipe stand is optimized by the further steps comprising:

(a) lowering said carriage along said arm member to a lowered position for said initial lifting of the rig end of the pipe stand, (b) rotating said arm member in said arc from said lowered position to said delivery/pickup position with said carriage in said lowered position and said holding in place of the rig end of the pipe stand during said rotation to said delivery/pickup position, (c) releasing the rig end of the pipe stand from said carriage when said arm member is in said delivery/pickup position for hook-up of the rig end of pipe stand to a hoist on the derrick, (d) during hoisting by the hoist of the pipe stand towards the vertical, elevating the carriage towards said distal end of said arm member and returning said arm member along said arc towards said vertical position and said lowered position.

18. The method of claim 17 further comprising the step of (e) during the hoisting allowing the pipe stand to run along its length through said clamp on said carriage, (f) once the pipe stand has run substantially at least half of its length through said clamp on said carriage then once again returning said arm member along said arc towards said delivery/pickup position, and with said carriage positioned at said distal end of said arm member, supporting the lower end of the pipe stand until hoisted clear of said arm member.

* * * * *